US006580233B2

(12) United States Patent
Nakanishi et al.

(10) Patent No.: US 6,580,233 B2
(45) Date of Patent: Jun. 17, 2003

(54) CATHODE RAY TUBE AND INTENSITY CONTROLLING METHOD

(75) Inventors: Satoru Nakanishi, Kanagawa (JP); Masamichi Okada, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/950,881

(22) Filed: Sep. 13, 2001

(65) Prior Publication Data

US 2002/0047658 A1 Apr. 25, 2002

(30) Foreign Application Priority Data

Sep. 13, 2000 (JP) ..... 2000-278757

(51) Int. Cl.[7] ..... G09G 1/04

(52) U.S. Cl. ..... 315/383; 315/368.12; 315/368.13; 315/370; 315/371

(58) Field of Search ..... 315/9, 366, 368.12, 315/368.13, 368.15, 367, 370, 371, 383, 403, 411; 348/380, 511, 514, 522, 572

(56) References Cited

U.S. PATENT DOCUMENTS 5,327,247 A * 7/1994 Osborne et al. ..... 348/100
5,694,003 A * 12/1997 Takahashi et al. ..... 315/10
6,304,034 B1 * 10/2001 Hosokawa et al. ..... 313/2.1
6,317,114 B1 * 11/2001 Abali et al. ..... 345/672

FOREIGN PATENT DOCUMENTS

| | | |
|---|---|---|
| JP | Sho 50-17167 | 2/1975 |
| JP | Hei 5-300452 | 11/1993 |
| JP | Hei 10-124656 | 10/1996 |
| JP | 2000-138946 | 5/2000 |
| JP | 2000-333102 | 11/2000 |

OTHER PUBLICATIONS

The Literature of SID digest, "The Camel CRT", A.A.S. Sluyterman, 1998, pp. 351–354.

* cited by examiner

*Primary Examiner*—Haissa Philogene
(74) *Attorney, Agent, or Firm*—Rader, Fishman & Grauer PLLC; Ronald P. Kananen, Esq.

(57) ABSTRACT

Disclosed is a cathode ray tube and a intensity controlling method achieving a reduced amount of factors for correcting intensity prepared and capable of performing proper intensity control so that the joint portion of split picture planes is inconspicuous from a viewpoint of intensity. With respect to the direction of overlapping a plurality of split picture planes, only correction factors at representative signal levels are pre-stored as a basic factor table. Any of the factors at the other signal levels is obtained by performing an interpolating operation using the basic factors in the basic factor table. The value of the signal level of a video signal referred to when the correction factor in the overlapping direction is obtained is changed by using a shift factor associated with the pixel position in the direction orthogonal to the overlapping direction. The basic factor is thereby changed according to the pixel position in the orthogonal direction.

9 Claims, 23 Drawing Sheets

640 PIXELS
352
320
32
X1
R
OL
480PIXELS
DSP CIRCUIT 50L

80L
OL
X1 (write)
read
L
480
352→480
FRAME MEMORY 56L

480
Xa
L
480
DSP CIRCUIT 55L2

480→640
Xa
L
480
D/A CONVERTER 57L

Y
480
L
640
ON PICTURE PLANE

FIG. 11A
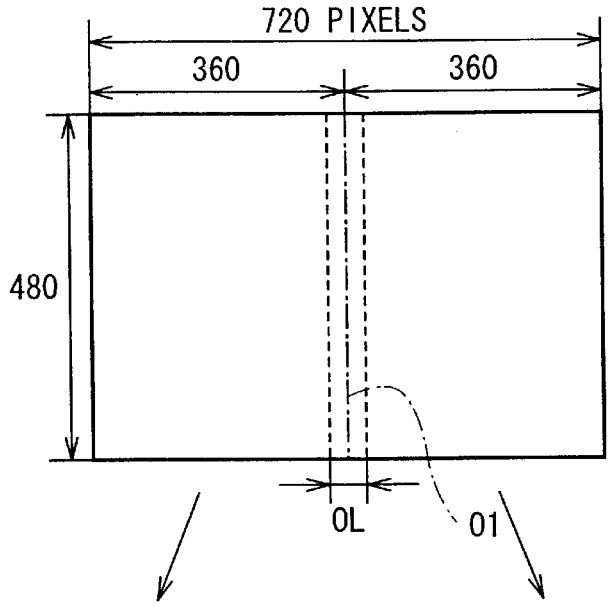
FIG. 11B
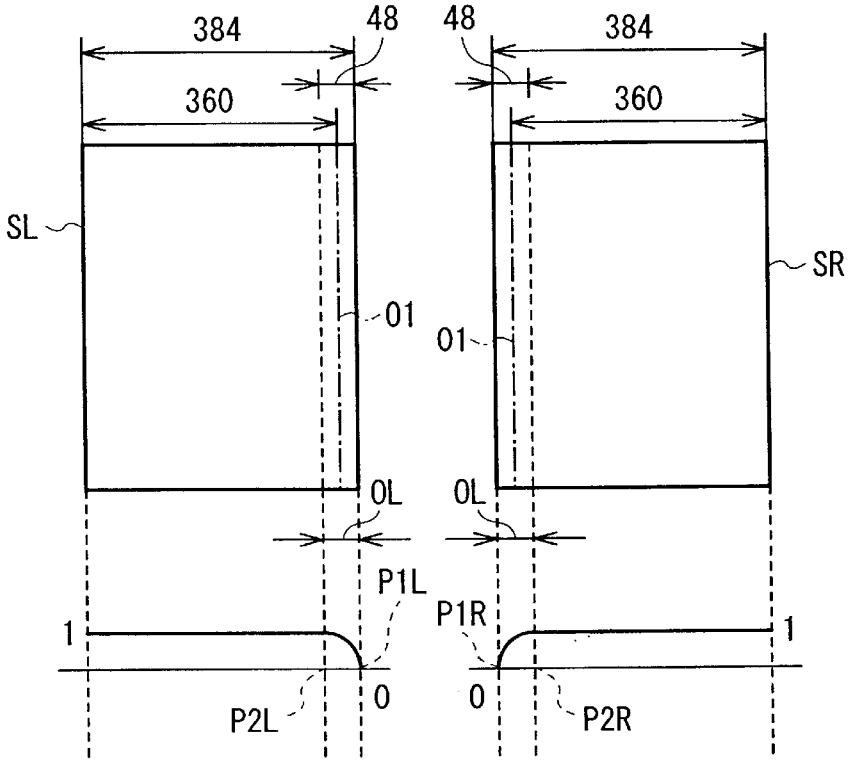
FIG. 11C

FACTOR NUMBERS { 1, 2, 3, 4, 5, 6, 7, 8, 9};

BASIC FACTOR FOR LEFT PICTURE PLANE

INTERPOLATION

PIXEL POSITION IN OVERLAPPING DIRECTION

```
cram WRx  0 = { 256 , 256 , 256 , 256 , 256 , 256 , 256 , 256 , 256 };
cram WGx  0 = { 256 , 256 , 256 , 256 , 256 , 256 , 256 , 256 , 256 };
cram WBx  0 = { 256 , 256 , 256 , 256 , 256 , 256 , 256 , 256 , 256 };

cram WRx  1 = { 256 , 256 , 255 , 256 , 256 , 256 , 256 , 255 , 256 };
cram WGx  1 = { 256 , 256 , 255 , 256 , 256 , 256 , 256 , 255 , 256 };
cram WBx  1 = { 256 , 256 , 255 , 256 , 256 , 256 , 256 , 255 , 256 };

cram WRx  2 = { 256 , 256 , 255 , 256 , 256 , 256 , 256 , 255 , 256 };
cram WGx  2 = { 256 , 256 , 255 , 256 , 256 , 256 , 256 , 255 , 256 };
cram WBx  2 = { 256 , 256 , 255 , 256 , 256 , 256 , 256 , 255 , 256 };

cram WRx  3 = { 256 , 256 , 254 , 256 , 256 , 256 , 256 , 254 , 256 };
cram WGx  3 = { 256 , 256 , 254 , 256 , 256 , 256 , 256 , 254 , 256 };
cram WBx  3 = { 256 , 256 , 254 , 256 , 256 , 256 , 256 , 254 , 256 };

cram WRx  4 = { 256 , 256 , 253 , 256 , 255 , 256 , 256 , 253 , 256 };
cram WGx  4 = { 256 , 256 , 253 , 256 , 256 , 256 , 255 , 253 , 256 };
cram WBx  4 = { 256 , 256 , 253 , 256 , 255 , 255 , 255 , 253 , 255 };
      .                       .
      .                       .
      .                       .
      .                       .
cram WRx 43 = {  64 ,  53 ,  38 ,  53 ,  43 ,  37 ,  37 ,  38 ,  37 };
cram WGx 43 = {  56 ,  52 ,  51 ,  50 ,  38 ,  35 ,  34 ,  51 ,  35 };
cram WBx 43 = {  49 ,  50 ,  43 ,  48 ,  35 ,  33 ,  33 ,  43 ,  33 };

cram WRx 44 = {  54 ,  44 ,  30 ,  44 ,  34 ,  28 ,  28 ,  30 ,  28 };
cram WGx 44 = {  46 ,  43 ,  42 ,  41 ,  28 ,  27 ,  26 ,  42 ,  27 };
cram WBx 44 = {  39 ,  41 ,  35 ,  40 ,  26 ,  25 ,  25 ,  35 ,  25 };

cram WRx 45 = {  45 ,  35 ,  23 ,  34 ,  25 ,  19 ,  19 ,  23 ,  19 };
cram WGx 45 = {  36 ,  33 ,  33 ,  32 ,  19 ,  18 ,  17 ,  33 ,  18 };
cram WBx 45 = {  30 ,  33 ,  27 ,  31 ,  18 ,  17 ,  17 ,  27 ,  17 };

cram WRx 46 = {  35 ,  25 ,  15 ,  25 ,  17 ,   9 ,  10 ,  15 ,   9 };
cram WGx 46 = {  26 ,  24 ,  23 ,  23 ,  10 ,   9 ,   9 ,  23 ,   9 };
cram WBx 46 = {  20 ,  23 ,  18 ,  22 ,   9 ,   8 ,   8 ,  18 ,   8 };

cram WRx 47 = {  25 ,  15 ,   7 ,  15 ,   8 ,   0 ,   0 ,   7 ,   0 };
cram WGx 47 = {  15 ,  14 ,  13 ,  14 ,   0 ,   0 ,   0 ,  13 ,   0 };
cram WBx 47 = {  10 ,  14 ,   9 ,  13 ,   0 ,   0 ,   0 ,   9 ,   0 };
```

FIG. 14

FACTOR NUMBERS { 1, 2, 3, 4, 5, 6, 7, 8, 9};

BASIC FACTOR FOR RIGHT PICTURE PLANE

INTERPOLATION

PIXEL POSITION IN OVERLAPPING DIRECTION

```
cram WRx 0 = { 25, 15, 8, 15, 8, 0, 0, 8, 0};
cram WGx 0 = { 15, 14, 10, 14, 0, 0, 0, 10, 0};
cram WBx 0 = { 10, 14, 9, 13, 0, 0, 0, 9, 0};

cram WRx 1 = { 35, 25, 16, 25, 17, 9, 10, 16, 9};
cram WGx 1 = { 26, 24, 20, 23, 10, 9, 9, 20, 9};
cram WBx 1 = { 20, 23, 17, 22, 9, 8, 8, 17, 8};

cram WRx 2 = { 45, 35, 23, 34, 25, 19, 19, 23, 19};
cram WGx 2 = { 36, 33, 29, 32, 19, 18, 17, 29, 18};
cram WBx 2 = { 30, 33, 25, 31, 18, 17, 17, 25, 17};

cram WRx 3 = { 54, 44, 31, 44, 34, 28, 28, 31, 28};
cram WGx 3 = { 46, 43, 38, 41, 28, 27, 26, 38, 27};
cram WBx 3 = { 39, 41, 34, 40, 26, 25, 25, 34, 25};

cram WRx 4 = { 64, 53, 39, 53, 43, 37, 37, 39, 37};
cram WGx 4 = { 56, 52, 46, 50, 38, 35, 34, 46, 35};
cram WBx 4 = { 49, 50, 42, 48, 35, 33, 33, 42, 33};
      .                    .
      .                    .
      .                    .
      .                    .

cram WRx 43 = {256, 256, 253, 256, 255, 256, 256, 253, 256};
cram WGx 43 = {256, 256, 253, 256, 256, 256, 255, 253, 256};
cram WBx 43 = {256, 256, 253, 256, 255, 255, 255, 253, 255};

cram WRx 44 = {256, 256, 254, 256, 256, 256, 256, 254, 256};
cram WGx 44 = {256, 256, 254, 256, 256, 256, 256, 254, 256};
cram WBx 44 = {256, 256, 254, 256, 256, 256, 256, 254, 256};

cram WRx 45 = {256, 256, 255, 256, 256, 256, 256, 255, 256};
cram WGx 45 = {256, 256, 255, 256, 256, 256, 256, 255, 256};
cram WBx 45 = {256, 256, 255, 256, 256, 256, 256, 255, 256};

cram WRx 46 = {256, 256, 255, 256, 256, 256, 256, 255, 256};
cram WGx 46 = {256, 256, 256, 256, 256, 256, 256, 256, 256};
cram WBx 46 = {256, 256, 255, 256, 256, 256, 256, 255, 256};

cram WRx 47 = {256, 256, 256, 256, 256, 256, 256, 256, 256};
cram WGx 47 = {256, 256, 256, 256, 256, 256, 256, 256, 256};
cram WBx 47 = {256, 256, 256, 256, 256, 256, 256, 256, 256};
```

FIG. 15

| NUMBER OF BASIC FACTOR | SIGNAL LEVEL |
|---|---|
| 1 | 0 |
| 2 | 32 |
| 3 | 64 |
| 4 | 96 |
| 5 | 128 |
| 6 | 160 |
| 7 | 192 |
| 8 | 224 |
| 9 | 255 |

INTERPOLATION

1～31

33～63

65～95

97～127

129～159

161～191

193～223

225～254

FIG. 16

FACTOR NUMBERS { 1, 2, 3, 4, 5, 6, 7, 8};

SHIFT FACTOR FOR LEFT PICTURE PLANE

PIXEL POSITION IN ORTHOGONAL DIRECTION

```
cram WRy  0 = { 0, -5, -10, -15, -20, -30, -35, -40};
cram WGy  0 = { 0, -4, -8, -12, -16, -24, -28, -32};
cram WBy  0 = { 0, -3, -6, -9, -12, -18, -21, -24};

cram WRy  1 = { 0, -4, -8, -12, -16, -24, -28, -32};
cram WGy  1 = { 0, -3, -6, -9, -12, -18, -21, -24};
cram WBy  1 = { 0, -2, -4, -6, -8, -12, -14, -16};

cram WRy  2 = { 0, -3, -6, -9, -12, -18, -21, -24};
cram WGy  2 = { 0, -2, -4, -6, -8, -12, -14, -16};
cram WBy  2 = { 0, -2, -4, -6, -8, -12, -14, -16};

cram WRy  3 = { 0, -2, -4, -6, -8, -12, -14, -16};
cram WGy  3 = { 0, -2, -4, -6, -8, -12, -14, -16};
cram WBy  3 = { 0, -2, -4, -6, -8, -12, -14, -16};

cram WRy  4 = { 0, -2, -4, -6, -8, -12, -14, -16};
cram WGy  4 = { 0, -2, -4, -6, -8, -12, -14, -16};
cram WBy  4 = { 0, -2, -4, -6, -8, -12, -14, -16};
      .                    .
      .                    .
      .                    .
      .                    .
cram WRy 475 = { -1, -2, -4, -6, -10, -12, -14, -16};
cram WGy 475 = { -1, -2, -4, -6, -10, -12, -14, -16};
cram WBy 475 = { -1, -2, -4, -6, -10, -12, -14, -16};

cram WRy 476 = { -1, -2, -4, -6, -10, -12, -14, -16};
cram WGy 476 = { -1, -2, -4, -6, -10, -12, -14, -16};
cram WBy 476 = { -1, -2, -4, -6, -10, -12, -14, -16};

cram WRy 477 = { 0, -2, -4, -6, -10, -12, -14, -16};
cram WGy 477 = { 0, -2, -4, -6, -10, -12, -14, -16};
cram WBy 477 = { 0, -3, -6, -9, -15, -18, -21, -24};

cram WRy 478 = { 0, -2, -4, -6, -10, -12, -14, -16};
cram WGy 478 = { 0, -3, -6, -9, -15, -18, -21, -24};
cram WBy 478 = { 0, -4, -8, -12, -20, -24, -28, -32};

cram WRy 479 = { 0, -3, -6, -9, -15, -18, -21, -24};
cram WGy 479 = { 0, -4, -8, -12, -20, -24, -28, -32};
cram WBy 479 = { 0, -5, -10, -15, -25, -30, -35, -40};
```

FIG. 17

FACTOR NUMBERS { 1, 2, 3, 4, 5, 6, 7, 8};

SHIFT FACTOR FOR RIGHT PICTURE PLANE

PIXEL POSITION IN ORTHOGONAL DIRECTION ↓

```
cram WRy  0 = { 0, -5, -10, -20, -25, -30, -35, -40};
cram WGy  0 = { 0, -4, -8, -16, -20, -24, -28, -32};
cram WBy  0 = { 0, -3, -6, -12, -15, -18, -21, -24};

cram WRy  1 = { 0, -4, -8, -16, -20, -24, -28, -32};
cram WGy  1 = { 0, -3, -6, -12, -15, -18, -21, -24};
cram WBy  1 = { 0, -2, -4, -8, -10, -12, -14, -16};

cram WRy  2 = { 0, -3, -6, -12, -15, -18, -21, -24};
cram WGy  2 = { 0, -2, -4, -8, -10, -12, -14, -16};
cram WBy  2 = { 0, -2, -4, -8, -10, -12, -14, -16};

cram WRy  3 = { 0, -2, -4, -8, -10, -12, -14, -16};
cram WGy  3 = { 0, -2, -4, -8, -10, -12, -14, -16};
cram WBy  3 = { 0, -2, -4, -8, -10, -12, -14, -16};

cram WRy  4 = { 0, -2, -4, -8, -10, -12, -14, -16};
cram WGy  4 = { 0, -2, -4, -8, -10, -12, -14, -16};
cram WBy  4 = { 0, -2, -4, -8, -10, -12, -14, -16};
      .                    .
      .                    .
      .                    .
      .                    .
cram WRy 475 = { 0, -2, -4, -6, -8, -12, -14, -16};
cram WGy 475 = { 0, -2, -4, -6, -8, -12, -14, -16};
cram WBy 475 = { 0, -2, -4, -6, -8, -12, -14, -16};

cram WRy 476 = { 0, -2, -4, -6, -8, -12, -14, -16};
cram WGy 476 = { 0, -2, -4, -6, -8, -12, -14, -16};
cram WBy 476 = { 0, -2, -4, -6, -8, -12, -14, -16};

cram WRy 477 = { 0, -2, -4, -6, -8, -12, -14, -16};
cram WGy 477 = { 0, -2, -4, -6, -8, -12, -14, -16};
cram WBy 477 = { 0, -3, -6, -9, -12, -18, -21, -24};

cram WRy 478 = { -1, -2, -4, -6, -8, -12, -14, -16};
cram WGy 478 = { -1, -3, -6, -9, -12, -18, -21, -24};
cram WBy 478 = { -1, -4, -8, -12, -16, -24, -28, -32};

cram WRy 479 = { -1, -3, -6, -9, -12, -18, -21, -24};
cram WGy 479 = { -1, -4, -8, -12, -16, -24, -28, -32};
cram WBy 479 = { -1, -5, -10, -15, -20, -30, -35, -40};
```

FIG. 18

| NUMBER OF SHIFT FACTOR | SIGNAL LEVEL |
|---|---|
| 1 | 0～31 |
| 2 | 32～63 |
| 3 | 64～95 |
| 4 | 96～127 |
| 5 | 128～159 |
| 6 | 160～191 |
| 7 | 192～223 |
| 8 | 224～255 |

FIG. 19

FACTOR NUMBERS { 1, 2, 3, 4, 5, 6, 7, 8};

SHIFT FACTOR FOR LEFT PICTURE PLANE

INTERPOLATION

NUMBER OF REPRESENTATIVE PIXEL POSITION IN ORTHOGONAL DIRECTION

```
cram WRy 0 = { 0, -5, -10, -15, -25, -30, -35, -40};
cram WGy 0 = { 0, -4, -8, -12, -20, -24, -28, -32};
cram WBy 0 = { 0, -3, -6, -9, -15, -18, -21, -24};

cram WRy 1 = { 0, -4, -8, -12, -20, -24, -28, -32};
cram WGy 1 = { 0, -3, -6, -9, -15, -18, -21, -24};
cram WBy 1 = { 0, -2, -4, -6, -10, -12, -14, -16};

cram WRy 2 = { 0, -3, -6, -9, -15, -18, -21, -24};
cram WGy 2 = { 0, -2, -4, -6, -10, -12, -14, -16};
cram WBy 2 = { 0, -2, -4, -6, -10, -12, -14, -16};

cram WRy 3 = { 0, -2, -4, -6, -10, -12, -14, -16};
cram WGy 3 = { 0, -2, -4, -6, -10, -12, -14, -16};
cram WBy 3 = { 0, -2, -4, -6, -10, -12, -14, -16};

cram WRy 4 = { 0, -2, -4, -6, -10, -12, -14, -16};
cram WGy 4 = { 0, -2, -4, -6, -10, -12, -14, -16};
cram WBy 4 = { 0, -2, -4, -6, -10, -12, -14, -16};

cram WRy 5 = { 0, -2, -4, -6, -10, -12, -14, -16};
cram WGy 5 = { 0, -3, -6, -9, -15, -18, -21, -24};
cram WBy 5 = { 0, -4, -8, -12, -20, -24, -28, -32};

cram WRy 6 = { 0, -2, -4, -6, -10, -12, -14, -16};
cram WGy 6 = { 0, -2, -4, -6, -10, -12, -14, -16};
cram WBy 6 = { 0, -2, -4, -6, -10, -12, -14, -16};

cram WRy 7 = { 0, -2, -4, -6, -10, -12, -14, -16};
cram WGy 7 = { 0, -2, -4, -6, -10, -12, -14, -16};
cram WBy 7 = { 0, -2, -4, -6, -10, -12, -14, -16};

cram WRy 8 = { 0, -2, -4, -6, -10, -12, -14, -16};
cram WGy 8 = { 0, -2, -4, -6, -10, -12, -14, -16};
cram WBy 8 = { 0, -3, -6, -9, -15, -18, -21, -24};
```

FIG. 21

FACTOR NUMBERS { 1, 2, 3, 4, 5, 6, 7, 8};

SHIFT FACTOR FOR RIGHT PICTURE PLANE

INTERPOLATION

NUMBER OF REPRESENTATIVE PIXEL POSITION IN ORTHOGONAL DIRECTION

```
cram WRy 0 = { 0, -5, -10, -15, -25, -30, -35, -40};
cram WGy 0 = { 0, -4, -8, -12, -20, -24, -28, -32};
cram WBy 0 = { 0, -3, -6, -9, -15, -18, -21, -24};

cram WRy 1 = { 0, -4, -8, -12, -20, -24, -28, -32};
cram WGy 1 = { 0, -3, -6, -9, -15, -18, -21, -24};
cram WBy 1 = { 0, -2, -4, -6, -10, -12, -14, -16};

cram WRy 2 = { 0, -3, -6, -9, -15, -18, -21, -24};
cram WGy 2 = { 0, -2, -4, -6, -10, -12, -14, -16};
cram WBy 2 = { 0, -2, -4, -6, -10, -12, -14, -16};

cram WRy 3 = { 0, -2, -4, -6, -10, -12, -14, -16};
cram WGy 3 = { 0, -2, -4, -6, -10, -12, -14, -16};
cram WBy 3 = { 0, -2, -4, -6, -10, -12, -14, -16};

cram WRy 4 = { 0, -3, -6, -9, -15, -18, -21, -24};
cram WGy 4 = { 0, -2, -4, -6, -10, -12, -14, -16};
cram WBy 4 = { 0, -2, -4, -6, -10, -12, -14, -16};

cram WRy 5 = { 0, -2, -4, -6, -10, -12, -14, -16};
cram WGy 5 = { 0, -2, -4, -6, -10, -12, -14, -16};
cram WBy 5 = { 0, -2, -4, -6, -10, -12, -14, -16};

cram WRy 6 = { 0, -2, -4, -6, -10, -12, -14, -16};
cram WGy 6 = { 0, -2, -4, -6, -10, -12, -14, -16};
cram WBy 6 = { 0, -2, -4, -6, -10, -12, -14, -16};

cram WRy 7 = { 0, -2, -4, -6, -10, -12, -14, -16};
cram WGy 7 = { 0, -2, -4, -6, -10, -12, -14, -16};
cram WBy 7 = { 0, -3, -6, -9, -15, -18, -21, -24};

cram WRy 8 = { 0, -2, -4, -6, -10, -12, -14, -16};
cram WGy 8 = { 0, -3, -6, -9, -15, -18, -21, -24};
cram WBy 8 = { 0, -4, -8, -12, -20, -24, -28, -32};
```

FIG. 22

| REPRESENTATIVE NUMBER OF PIXEL POSITION | PIXEL POSITION IN ORTHOGONAL DIRECTION |
|---|---|
| 0 | 0 |
| 1 | 60 |
| 2 | 120 |
| 3 | 180 |
| 4 | 240 |
| 5 | 300 |
| 6 | 360 |
| 7 | 420 |
| 8 | 479 |

INTERPOLATION

1～59

61～119

121～179

181～239

241～299

301～359

361～419

421～478

FIG. 23

CATHODE RAY TUBE AND INTENSITY CONTROLLING METHOD

BACKGROUND OF THE INVENTION

1. Field of the Invention

The present invention relates to a cathode ray tube for displaying an image by forming a single picture plane by joining a plurality of split picture planes, and an intensity controlling method.

2. Description of the Related Art

At present, a cathode ray tube (CRT) is widely used in an image display apparatus (such as a television receiver, various monitors, and the like). In the CRT, an electron beam is emitted from an electron gun provided in the tube toward a phosphor screen and is electromagnetically deflected by a deflection yoke or the like, thereby forming a scan image according to the scan with the electron beam on the tube screen.

Generally, a CRT has a single electron gun. In recent years, a CRT having a plurality of electron guns is also being developed. For example, a gun type having two of electron guns for emitting three electron beams of red (R), green (G), and blue (B) has been developed (in-line electron gun type). In the CRT of the in-line electron gun type, a plurality of split picture planes are formed by a plurality of electron beams emitted from the plurality of electron guns and are joined, thereby displaying a single image. For example, the techniques related to the CRT of the in-line electron gun type are disclosed in Japanese Patent Laid-open No. Sho 50-17167, and the like. Such a CRT having a plurality of electron guns has an advantage that a larger screen can be achieved while reducing the depth as compared with a CRT using a single electron gun.

Methods of joining split picture planes in a CRT of the in-line electron gun type or the like includes a method of obtaining a single picture plane by linearly joining end portions of the split picture planes and a method of obtaining a single picture plane by partially overlapping neighboring split picture planes. FIGS. 1A and 1B show an example of obtaining a single picture plane by overlapping neighboring end portions of two split picture planes SR and SL as an example of forming a picture plane. In the example, the central portion of the picture plane is an overlapped area OL of the two split picture planes SR and SL.

In the CRT of the in-line electron gun type and the like, when a single picture plane is displayed by joining a plurality of split picture planes, it is desirable to make the joint of the split picture planes inconspicuous. Conventionally, however, the technique of making the joint inconspicuous has been insufficiently developed. For example, when the intensity at the joint portion is not properly adjusted, what is called intensity unevenness such that variation occurs in magnitude of intensity in the neighboring split picture planes. Conventionally, the technique of reducing the intensity unevenness has been insufficiently developed. In the case of obtaining a single picture plane by partially overlapping the neighboring split picture planes SR and SL as shown in FIGS. 1A and 1B, such intensity unevenness becomes a problem in the overlapped area OL of the neighboring split picture planes.

A method of reducing the intensity unevenness as described above is disclosed in, for example, the literature of SID digest, pp 351–354, 23.4: "The Camel CRT". The technique disclosed in the literature will be described by referring to FIGS. 1A and 1B. In the technique, a video signal corresponding to the overlapped area OL of the picture planes in a CRT is multiplied by a predetermined factor for correction in accordance with the position in the horizontal direction of a pixel (direction of overlapping the picture planes, that is, the X direction in FIG. 1B), that is, the signal level of an input signal is changed according to the direction of overlapping the picture planes and the resultant is output. In the method, for example, the level of the input signal for each of the picture planes corresponding to the overlapped area OL is corrected to have a sine function shape so that a value obtained by adding the intensity levels of input signals in the same pixel positions Pi.j (Pi.j1, Pi.j2) of the overlapped picture planes SL and SR is equal to the intensity in the same pixel position in an original image. However, such method has difficulty in improving the intensity in the entire intensity area, although the intensity can be improved in a part of an intensity area.

The problem in the conventional method of reducing the intensity unevenness will be described further in detail hereinbelow. Generally, the intensity Y of the screen in a CRT or the like is expressed by the following equation (1) when the level of an input signal is D and a characteristic value (gamma value) indicative of so-called gamma characteristic is γ. C is generally called perveance which is a coefficient determined according to the structure of the electronic gun or the like.

$$Y=C\times D\gamma \tag{1}$$

The intensity distribution in the case where a single picture plane is formed by partially overlapping the two split picture planes like the example of FIGS. 1A and 1B will be considered. When gamma values in the two split picture planes SL and SR are γ1 and γ2, respectively, intensity Y'1 and Y'2 in the two split picture planes SL and SR in the overlapped area OL can be expressed by the following equations (2) and (3) similar to the above equation (1). In the equations (2) and (3), k1 and k2 are factors for correction by which the input signal D corresponding to the overlapped area OL in the picture plane is multiplied in accordance with the pixel position Pi.j. C1 and C2 denote predetermined coefficients corresponding to the coefficient C in the equation (1).

$$Y'1=C1\times(k1\times D)\gamma^1 \tag{2}$$

$$Y'2=C2\times(k2\times D)\gamma^2 \tag{3}$$

When the intensity in the two split picture planes SL and SR except for the overlapped area are Y1 and Y2, respectively, if the level of the input signal is the same in the entire area of the picture plane, the intensity is expected to be constant in the entire area of the picture plane. The condition under which the intensity unevenness does not occur can be expressed by the following equation (4). Y'1+Y'2 is a value obtained by adding the intensity values in the two split picture planes SL and SR in the overlapped area OL. When the equation (4) is solved, the following relational expression (5) is derived.

$$Y1=Y2=Y'1+Y'2 \tag{4}$$

$$k1\gamma^1+k2\gamma^2=1 \tag{5}$$

In the relational expression (5), when the gamma values γ1 and γ2 are fixed values, the factors k1 and k2 for correction can be unconditionally determined irrespective of the level of the input signal. In practice, however, as shown in FIG. 2, the gamma value depends on the level of the input signal and the intensity of the picture plane and is not constant.

The characteristic graph of FIG. 2 shows the relation between the level of an input signal (lateral axis) and the magnitude of intensity (cd/m$^2$) actually measured on the screen (vertical axis). The graph is obtained by locally linearly connecting actual measurement points (indicated by painted dots • in the graph) each indicative of the value of the input signal and the value of intensity. In FIG. 2, the value of the input signal and the value of intensity are expressed as logarithm values. The gamma value γ corresponds to the gradient of the graph (straight line). When the gradient of the graph is constant irrespective of the level of the input signal, the gamma value γ is constant irrespective of the level of the input signal. In practice, however, the gradient of the graph varies according to the level of the input signal. It is therefore understood that the gamma value γ varies according to the level of the input signal. Consequently, in order to satisfy the condition of the equation (5), a plurality of factors k1 and k2 for correction according to the level of an input signal are inherently necessary.

Particularly, in the case of a moving picture, usually, the level of the input signal dynamically changes. Consequently, it is desirable to control the intensity so that the factor for correction is dynamically to be an optimum one in accordance with the level of an input signal even in the same pixel position. In the conventional technique, however, the control of using a fixed factor irrespective of the level of the input signal is performed, and the control of dynamically changing the factor for correction in accordance with the level of the input signal is not performed. Conventionally, the intensity can be improved in a part of the intensity area, but not in the entire intensity area.

Japanese Patent Laid-open No. Hei 5-300452 discloses an invention to achieve smoothed intensity in the overlap area by preparing a plurality of smoothing curves for intensity control corresponding to the correction factors and selecting a curve according to the characteristic of an image projector or the like from the plurality of smoothing curves. According to the invention, the optimum curve is selected from the plurality of smoothing curves, information of the selected specific smoothing curve is stored in a non-volatile storage device, and the intensity is smoothed on the basis of the stored smoothing curve. In order to control the intensity in accordance with the signal level, a means for detecting the signal level is necessary. The publication however does not disclose or suggest the means for detecting the signal level. According to the invention disclosed in the publication, only the selected specific smoothing curve is stored in the non-volatile storage device. Therefore, the intensity cannot be dynamically adjusted while an image display apparatus is being used. In the invention disclosed in the publication, as long as a new smoothing curve is not stored in the nonvolatile storage device, the intensity control using the same smoothing curve is performed.

According to the invention of Japanese Patent Laid-open No. Hei 5-300452, therefore, the intensity control according to the signal level cannot be performed. The invention disclosed in the publication is a technique for optimizing the intensity adjustment performed mainly at the time of manufacture. The invention is not suited for performing the intensity control in a real-time manner while the device is being used. Although an analog control using the smoothing curve is carried out on a video signal in the invention disclosed in the publication, to adjust the intensity accurately, it is desirable to perform a digital intensity control using a correction factor independent for each unit pixel or unit pixel line. The invention disclosed in the publication is optimized for a projection type image display apparatus and is not suitable for display means for directly displaying an image by a scan with an electron beam like a cathode ray tube.

Since the gamma value γ is influenced not only by the input signal but also by other factors, it is desirable to determine the factor for correcting intensity in consideration of the other various factors. For example, the gamma value γ varies also according to colors. Consequently, in the case of displaying a color image, correction factors for respective colors are necessary. In a CRT, the characteristics of the gamma value γ also vary according to characteristics of electron guns. It is therefore desirable to determine the correction factor in consideration of the characteristics of the electron gun and the like.

Further, as will be described hereinbelow, it is desirable to change the factor for correcting intensity in accordance with the position in the horizontal direction of a pixel (direction of overlapping the picture planes) and, in addition, in the perpendicular direction (the direction orthogonal to the direction of overlapping the picture planes, that is, the Y direction of FIG. 1B). The reason will be described by referring to FIGS. 1A and 1B. The intensity of a pixel in a position A (1A, 2A) and that of a pixel in a position B (1B, 2B) which are different from each other in the vertical direction in the overlapped area OL will be examined. When gamma values in positions 1A and 1B in the left-side split picture plane SL are set as γ1A and γ1B, respectively, intensity values $Y'_{1A}$ and $Y'_{1B}$ in the positions 1A and 1B obtained by performing a signal process using correction factors $k_{1A}$ and $k_{1B}$ on the input signal are expressed by the following equations (6) and (7), respectively, in a manner similar to the equation (1). $C_{1A}$ and $C_{1B}$ denote predetermined coefficients corresponding to the coefficient C in the equation (1).

$$Y'_{1A}=C_{1A}\times(k_{1A}\times D)\gamma^{1A} \tag{6}$$

$$Y'_{1B}=C_{1B}\times(k_{1B}\times D)\gamma^{1B} \tag{7}$$

On the other hand, when gamma values in positions 2A and 2B in the right-side split picture plane SR are set as γ2A and γ2B, respectively, intensity values $Y'_{2A}$ and $Y'_{2B}$ in the positions 2A and 2B obtained by performing a signal process using correction factors $k_{2A}$ and $k_{2B}$ on the input signal D are expressed by the following equations (8) and (9), respectively. $C_{2A}$ and $C_{2B}$ denote predetermined coefficients corresponding to the coefficient C in the equation (1).

$$Y'_{2A}=C_{2A}\times(k_{2A}\times D)\gamma^{2A} \tag{8}$$

$$Y'_{2B}=C_{2B}\times(k_{2B}\times D)\gamma^{2B} \tag{9}$$

When the intensity values in the positions 1A, 2A, 1B and 2B in the case of displaying an image only by a single electron gun are set as $Y_{1A}$, $Y_{2A}$, $Y_{1B}$, and $Y_{2B}$, respectively, the conditions under which no intensity unevenness occurs can be expressed by the following equations (10) and (11). $Y'_{1A}+Y'_{2A}$ and $Y'_{1B}+Y'_{2B}$ are values obtained by adding the intensity values of the two split picture planes SL and SR in the pixel positions A and B, respectively. When the equations (10) and (11) are solved, the following relational expressions (12) and (13) are derived, respectively.

$$Y_{1A}=Y_{2A}=Y'_{1A}+Y'_{2A} \tag{10}$$

$$Y_{1B}=Y_{2B}=Y'_{1B}+Y'_{2B} \tag{11}$$

$$k_{1A\gamma}{}^{1A}+k_{2A\gamma}{}^{2A}=1 \quad (12)$$

$$k_{1B\gamma}{}^{1B}+k_{2B\gamma}{}^{2B}=1 \quad (13)$$

In a CRT, generally, transmittance of light and light generating efficiency vary according to the position of a pixel in a phosphor screen. The spot size of an electron beam or the like also varies according to the position of a pixel in the phosphor screen. Since the gamma value γ varies according to the position of a pixel in the phosphor screen, the following equation (14) is therefore satisfied. Further, by the equations (12) to (14), the equation (15) is satisfied. It is understood from the equation (15) that it is preferable to control not only the intensity according to the position of a pixel in the horizontal direction as in the conventional technique but also the intensity in accordance with the position of a pixel in the vertical direction.

$$\gamma 1A \neq \gamma 2A,\ \gamma 1B \neq \gamma 2B \quad (14)$$

$$k_{1A} \neq k_{2A},\ k_{1B} \neq k_{2B} \quad (15)$$

As described above, in order to perform an intensity control so as to make the joint portion inconspicuous from the viewpoint of intensity, desirably, factors for intensity correction are prepared for the pixel positions in the horizontal and vertical directions in the joint portion and at different signal levels, and the correction factor to be used for controlling the intensity is changed properly. To realize such intensity control, for example, there may be a method of pre-storing a number of correction factors according to the pixel positions, at different signal levels, and the like in the form of a table, and obtaining an optimum correction factor from the table in accordance with a change in the signal level or the like. However, when correction factors are prepared for all the pixel positions and at the all signal levels, the data amount becomes enormous. Such a method requires a work of pre-setting an optimum correction factor for each pixel position or signal level, so that it takes enormous time for the setting work occurs.

SUMMARY OF THE INVENTION

The present invention has been achieved in consideration of the problems and its object is to provide a cathode ray tube and an intensity controlling method that realizes the reduced number of factors for correcting intensity to be prepared in advance and can properly control the intensity so that the joint portion becomes inconspicuous from the viewpoint of intensity.

A cathode ray tube according to the invention includes: signal dividing means for dividing an input video signal into a plurality of video signals; first factor storing means for storing at least some of a plurality of first correction factors associated with signal levels of the video signals and pixel positions in a direction orthogonal to the overlapping direction, the some first correction factors being associated with representative pixel positions; and second factor storing means for storing at least some of a plurality of second correction factors associated with signal levels of the video signals and pixel positions in a overlapping direction, the some second correction factors being associated with the representative signal levels. The cathode ray tube according to the invention also has: first factor obtaining means for directly or indirectly obtaining a necessary first correction factor by using the first correction factors stored in the first factor storing means on the basis of a signal level of a present video signal and a pixel position in the orthogonal direction corresponding to the present video signal; changing means for changing a value of the signal level of a video signal referred to when the second correction factor is obtained on the basis of the first correction factor obtained by the first factor obtaining means; and second factor obtaining means for directly or indirectly obtaining the second correction factor to be used for intensity modulation control by using the second correction factor stored in the second factor storing means on the basis of the signal level changed by the changing means and the pixel position in the overlapping direction corresponding to the present video signal. The cathode ray tube according to the invention further includes: control means for performing the intensity modulation control on each of the video signals for the plurality of split picture planes so that a total of intensity values in the same pixel position in an overlapped area on the picture plane scanned based on the video signals for the plurality of split picture planes becomes equal to the intensity in the same pixel position in an original image by using the second correction factor obtained by the second factor obtaining means; and a plurality of electron guns for emitting a plurality of electron beams with which the plurality of split picture planes are scanned on the basis of a video signal modulated by the control means.

An intensity controlling method according to the present invention includes: a step of directly or indirectly obtaining a necessary first correction factor on the basis of the signal level of a present video signal and a pixel position in the orthogonal direction corresponding to the present video signal by using the first correction factors stored in the first factor storing means; a step of changing a value of the signal level of a video signal which is referred to when the second correction factor is obtained on the basis of the first correction factor obtained; a step of directly or indirectly obtaining a second correction factor to be used for intensity modulation control on the basis of the changed signal level and the pixel position in the overlapping direction corresponding to the present video signal by using the second correction factors stored in the second factor storing means; and a step of performing the intensity modulation control on each of the video signals for the plurality of split picture planes so that a total of intensity values in the same pixel position in an overlapped area on the picture plane scanned on the basis of the video signals for the plurality of split picture planes becomes equal to the intensity in the same pixel position in an original image by using the second correction factor obtained.

In the cathode ray tube and the intensity controlling method according to the invention, the first correction factor required is obtained directly or indirectly by using the first correction factors stored in the first factor storing means. And the value of the signal level of the video signal which is referred to when the second correction factor is obtained is changed on the basis of the first correction factor obtained. On the basis of the changed signal level and the pixel position in the overlapping direction corresponding to the present video signal, the second correction factor to be used for intensity modulation control is directly or indirectly obtained by using the second correction factors stored in the second factor storing means. By using the second correction factor obtained, the intensity modulation control is performed on each of the video signals for the plurality of split picture planes so that a total of intensity values in the same pixel position in an overlapped area on the picture plane scanned on the basis of the video signals for the plurality of split picture planes becomes equal to the intensity in the same pixel position in an original image.

Other and further objects, features and advantages of the invention will appear more fully from the following description.

BRIEF DESCRIPTION OF THE DRAWINGS

FIG. 3B is front view showing a scan direction of an electron beam in the cathode ray tube, and FIG. 3A is a cross section taken along line IA—IA of FIG. 3B.

FIGS. 11A to 11C are explanatory diagrams for explaining a signal process related to intensity performed in the processing circuit shown in FIG. 5.

FIG. 14 is an explanatory diagram showing an example of correction factors (basic factors) regarding an overlapping direction of a left-side split picture plane used for the intensity control.

FIG. 15 is an explanatory diagram showing an example of the correction factors (basic factors) regarding an overlapping direction of a right-side split picture plane used for the intensity control.

FIG. 16 is an explanatory diagram showing an example of a corresponding relation between the basic factor and the signal level of a video signal shown in FIGS. 14 and 15.

FIG. 17 is an explanatory diagram showing an example of the correction factor (shift factor) with respect to an orthogonal direction for the left-side split picture plane used for the intensity control.

FIG. 18 is an explanatory diagram showing an example of the correction factor (shift factor) with respect to the orthogonal direction for the right-side split picture plane used for the intensity control.

FIG. 19 is an explanatory diagram showing an example of the corresponding relation between the shift factor and the signal level of a video signal shown in FIGS. 17 and 18.

FIG. 21 is an explanatory diagram showing an example of the correction factor (shift factor) with respect to a representative pixel position in the orthogonal direction for the left-side split picture plane used for a cathode ray tube according to a second embodiment of the invention.

FIG. 22 is an explanatory diagram showing an example of the correction factor (shift factor) with respect to a representative pixel position in the orthogonal direction for the right-side split picture plane used for the cathode ray tube according to the second embodiment of the invention.

FIG. 23 is an explanatory diagram showing an example of the corresponding relation between the shift factor and the pixel position in the orthogonal direction illustrated in FIGS. 21 and 22.

DETAILED DESCRIPTION OF THE PREFERRED EMBODIMENTS

Embodiments of the invention will be described in detail hereinbelow with reference to the drawings.

First Embodiment

Figure 3A:
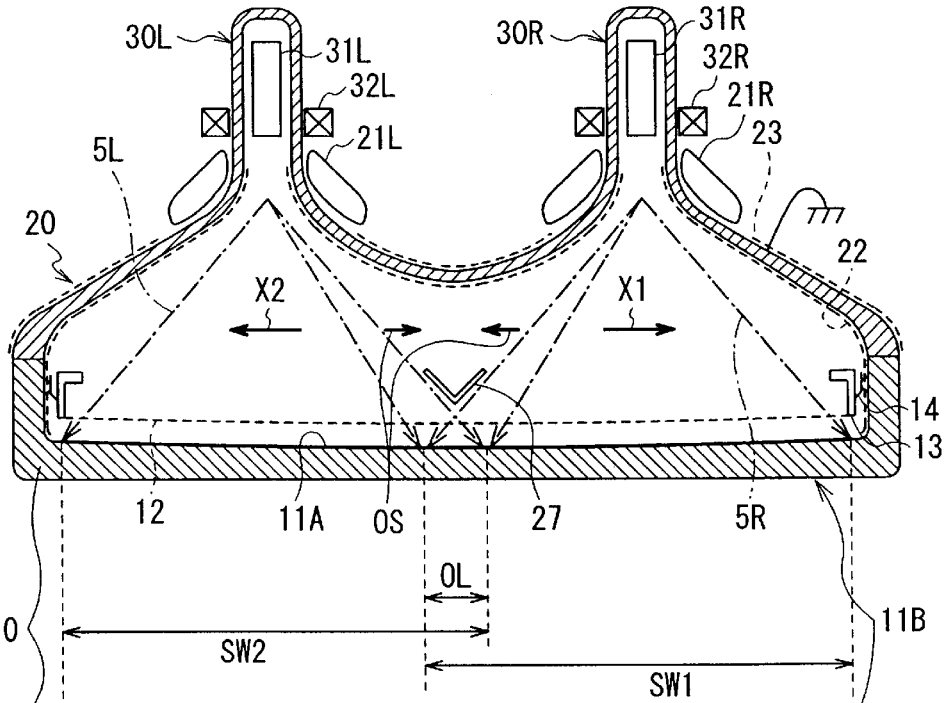
FIGS. 3A and 3B are diagrams schematically showing a cathode ray tube according to a first embodiment of the invention.
Figure 3B:
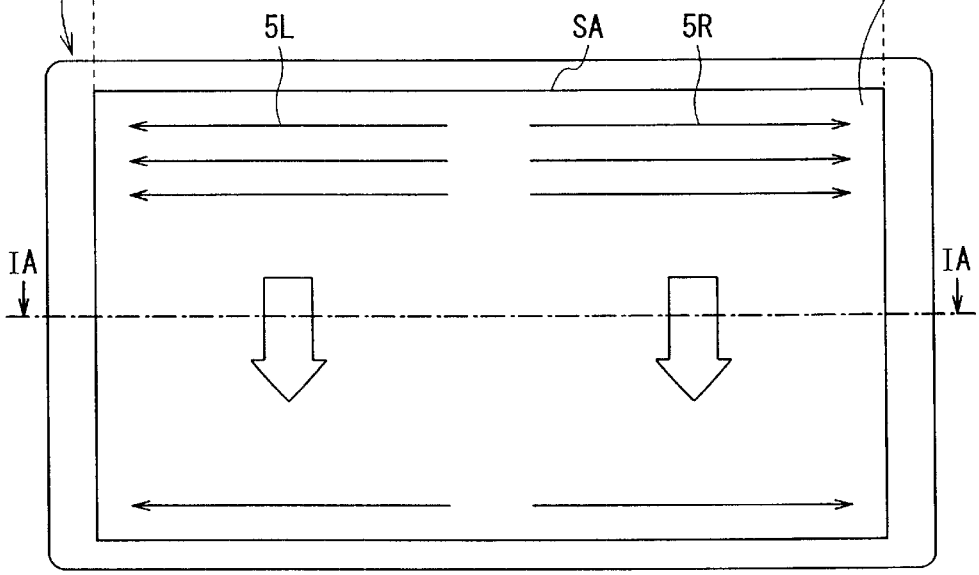

As shown in FIGS. 3A and 3B, a cathode ray tube according to the embodiment has a panel portion 10 in which a phosphor screen 11A is formed and a funnel portion 20 integrated with the panel portion 10. On rear end portions of the funnel portion 20, two neck portions 30R and 30L having therein electron guns 31R and 31L, respectively are formed. The cathode ray tube has an appearance of the shape of two funnels as a whole by the panel portion 10, funnel portion 20, and neck portions 30R and 30L. The opening of the panel portion 10 and that of the funnel portion 20 are fusion connected to each other and an inside of the cathode ray tube can be maintained in a state of high vacuum. In the phosphor screen 11A, a phosphor pattern which emits light by an incident electron beam is formed. The surface of the panel portion 10 serves as an image display screen (tube screen) 11B on which an image is displayed by light emission of the phosphor screen 11A.

At the inside of the cathode ray tube, a color selection mechanism 12 constructed by a thin plate made of a metal is disposed so as to face the phosphor screen 11A.

To the peripheral portion from the funnel portion 20 to the neck portions 30R and 30L, deflection yokes 21R and 21L and convergence yokes 32R and 32L are attached. The deflection yokes 21R and 21L are used to deflect electron beams 5R and 5L emitted from the electron guns 31R and 31L, respectively. The convergence yokes 32R and 32L converge the electron beams for respective colors emitted from the electron guns 31R and 31L.

The inner peripheral face from the neck portion 30 to the phosphor screen 11A of the panel portion 10 is covered with an inner conductive film 22. The inner conductive film 22 is electrically connected to the anode terminal 24 (not shown). The anode voltage HV is applied to the inner conductive film 22. The outer peripheral face of the funnel portion 20 is covered with an external conductive film 23.

Each of the electron guns 31R and 31L has, although not shown, three cathodes for R (Red), G (Green), and B (Blue), a heater for heating each cathode, and a plurality of grid electrodes disposed in front of the cathodes. When the cathode is heated by the heater and a cathode drive voltage of a magnitude according to a video signal is applied to the cathode, the cathode emits thermoelectrons of an amount according to the video signal. When the anode voltage HV, a focus voltage, or the like is applied to the grid electrode, the grid electrode forms an electron lens system to exert a lens action on an electron beam emitted from the cathode. By the lens action, the grid electrode converges an electron beam emitted from the cathode, controls the emission amount of the electron beams, performs an acceleration control, and the like. The electron beams for respective colors emitted from the electron guns 31R and 31L are irradiated on the phosphors of corresponding colors in the phosphor screen 11A via the color selection mechanism 12 or the like.

By referring to FIGS. 3B and 4, the outline of the scanning method of an electron beam in the cathode ray tube will be described. In the cathode ray tube, almost the left half of a picture plane is formed with the electron beam 5L emitted from the electron gun 31L disposed on the left side. Almost the right half of the screen is formed with the electron beam 5R emitted from the electron gun 31R disposed on the right side. By joining the ends of the split picture planes formed by the right and left electron beams 5R and 5L so as to be partially overlapped with each other, a single picture plane SA is formed as a whole, thereby forming an image. The central portion of the picture plane SA formed as a whole is an area OL in which the right and left split picture planes are overlapped. The phosphor screen 11A in the overlapped area OL is shared by the electron beams 5R and 5L.

The scan method shown in FIG. 3B performs what is called line scan (main scan) in the horizontal direction and carries out what is called field scan in the vertical deflection direction from top to bottom. In the example of the scan shown in FIG. 3B, the line scan is performed with the left-side electron beam 5L from right to left (direction X2 in FIG. 3A) in the horizontal deflection direction when seen from the image display screen side. On the other hand, the line scan is performed with the right-side electron beam 5R in the horizontal deflection direction from left to right (direction of X1 in FIG. 3A) when seen from the image display screen side. In the example of the scan shown in FIG. 3B, therefore, the line scan with the electron beams 5R and 5L is performed in the horizontal direction toward the opposite outer sides from the center portion of the screen. The field scan is performed from top to bottom like in a general cathode ray tube. In the scan method, the line scans with the electron beams 5R and 5L may be also performed in the directions opposite to those of FIG. 3B from the outer sides of the screen toward the central portion of the screen. The scan directions of the electron beams 5R and 5L may be set to the same direction.

Figure 4:
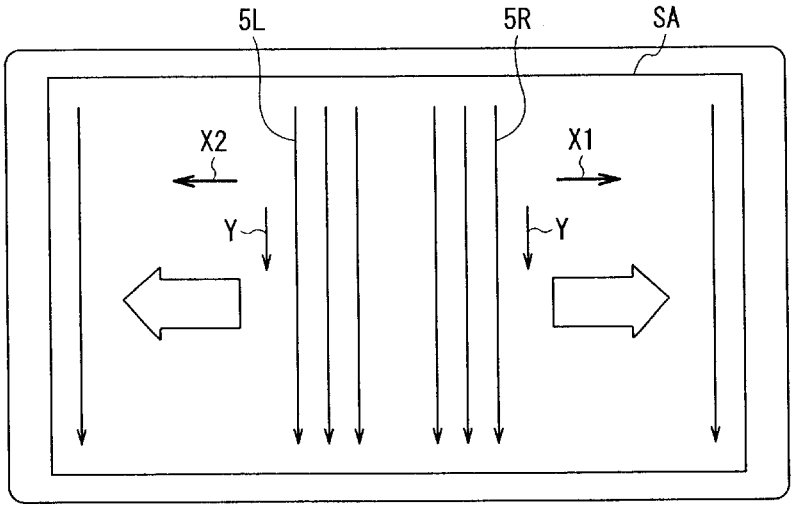
FIG. 4 is an explanatory diagram showing another example of the scan directions of electron beams.

The line scan and the field scan with the electron beams 5R and 5L in a scan method shown in FIG. 4 are performed in the reverse directions of the line scan and the filed scan with the electron beams 5R and 5L in the scan method shown in FIG. 3B. Since the line scan is performed in the vertical direction, the scan method is also called a vertical scan method. In the example of the scan shown in FIG. 4, the line scan with the electron beams 5R and 5L is performed from top to bottom (Y direction in FIG. 4). On the other hand, the field scan with the left-side electron beam 5L is performed from right to left (X2 direction in FIG. 4) when it is seen from the image display screen side, and the field scan with the right-side electron beam 5R is performed from left to right (X1 direction in FIG. 4) when it is seen from the image display screen side. In the example of the scan in FIG. 4, therefore, the field scan with the electron beams 5R and 5L is performed horizontally from the center portion in the screen toward the outside in the opposite directions. In the scan method, the field scans with the electron beams 5R and 5L may be also performed from the outer sides of the screen toward the center portion of the screen in a manner opposite to the case of FIG. 4.

In an over scan area OS of the electron beams 5R and 5L in the joint side of the neighboring right and left split picture planes (almost center portion of the whole screen) in the cathode ray tube, a V-shaped beam shield 27 as a shielding member against the electron beams 5R and 5L is disposed. The beam shield 27 has the function of shielding against the electron beams 5R and 5L. The beam shield 27 is, for example, provided so as to be sustained by the frame 13 for supporting the color selection mechanism 12 as a base. The beam shield 27 is electrically connected to the inner conductive film 22 via the frame 13.

In FIG. 3, an area SW1 is a valid picture plane on the phosphor screen 11A in the horizontal direction of the electron beam 5R, and an area SW2 is a valid picture plane on the phosphor screen 11A in the horizontal direction of the electron beam 5L.

Figure 5:
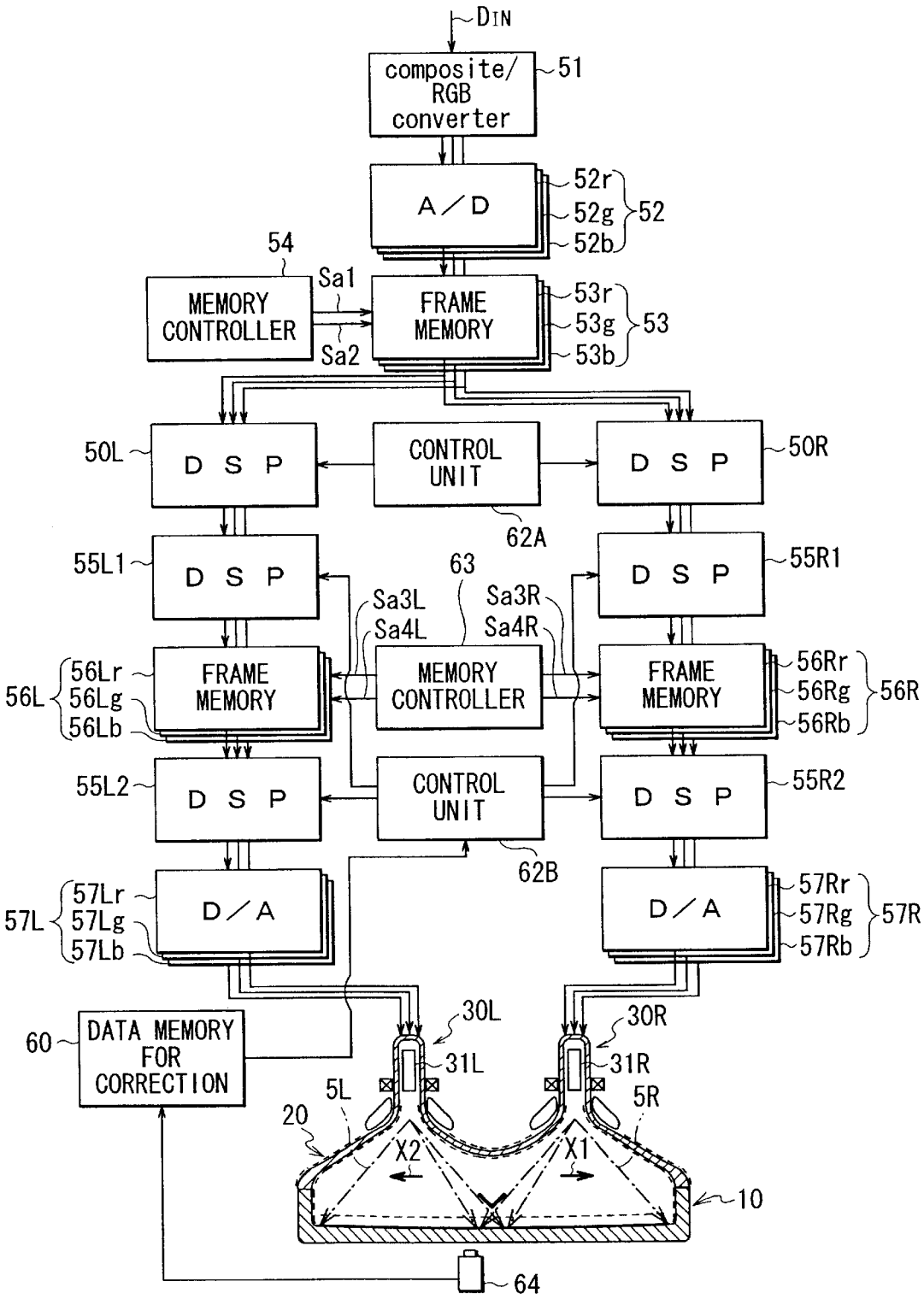
FIG. 5 is a block diagram showing an example of the configuration of a signal processing circuit in the cathode ray tube illustrated in FIGS. 3A and 3B.

FIG. 5 shows an example of a circuit for one-dimensionally receiving an analog composite signal of the NTSC (National Television System Committee) system as an image signal (video signal) $D_{IN}$ and displaying a moving picture according to the signal.

The cathode ray tube has, as shown in FIG. 5, a composite RGB converter 51, an analog-to-digital (hereinafter, A/D) converter 52 (52*r*, 52*g*, and 52*b*), a frame memory 53 (53*r*, 53*g*, and 53*b*), and a memory controller 54.

The composite RGB converter 51 converts the analog composite signal input as the image signal $D_{IN}$ to a signal each for R, G, or B. The A/D converter 52 converts the analog signal for each color output from the composite RGB converter 51 to a digital signal. The frame memory 53 two-dimensionally stores digital signals of each color output from the A/D converter 52 on a frame unit basis. As the frame memory 53, for example, an SDRAM (Synchronous Dynamic Random Access Memory) or the like is used. The memory controller 54 generates a write address and a read address of the image data for the frame memory 53 and performs operation of writing/reading image data to/from the frame memory 53. The memory controller 54 reads image data for an image formed by the left-side electron beam 5L and image data for an image formed by the right-side electron beam 5R from the frame memory 53 and outputs the read image data.

The cathode ray tube further has a DSP (Digital Signal Processor) circuit 50L, a DSP circuit 55L1, frame memories 56L (56Lr, 56Lg, and 56Lb), a DSP circuit 55L2, and digital-to-analog (hereinafter, D/A) converters 57L (57Lr, 57Lg, and 57Lb) for performing control on the image data for the left-side split plane. The cathode ray tube further has a DSP circuit 50R, a DSP circuit 55R1, frame memories 56R (56Rr, 56Rg, and 56Rb), a DSP circuit 55R2, and D/A converters 57R (57Rr, 57Rg, and 57Rb) for performing control on the image data for the right-side split plane.

The DSP circuits 50R and 50L are intensity control circuits provided mainly for intensity modulation control. On the other hand, the other DSP circuits 55L1, 55L2, 55R1, and 55R2 (hereinbelow, the four DSP circuits will be also generically called "DSP circuit 55") are position control circuits provided mainly for position correction.

The cathode ray tube also has a data memory 60 for correction for storing correction data of each color for correcting a display state of an image, and a control unit 62A for intensity control to which image data of each color stored in the frame memory 53 is input and which performs intensity control on the DSP circuits 50R and 60L. The cathode ray tube also has: a control unit 62B to which correction data is input from the data memory 60 for correction and which executes position correction on the DSP circuit 55 for position correction; and a memory controller 63 for generating a write address and a read address of image data for the frame memories 56R and 56L and controlling the operation of writing/reading image data to/from the frame memories 56R and 56L. The control unit 62A has, although not shown, a memory for storing a plurality of correction factors used for intensity control.

Mainly, the control unit 62A corresponds to an example of "first factor storing means", "second factor storing means", "first factor obtaining means", "second factor obtaining means", and "changing means" in the invention. Mainly, each of the DSP circuits 50R and 50L corresponds to a concrete example of "control means" in the invention.

The data memory 60 for correction has memory areas for the respective colors for both the right and left split picture planes and stores correction data for each color in each of the memory areas. The correction data to be stored in the data memory 60 for correction is, for example, data generated to correct raster distortion or the like in the initial state of the CRT at the time of manufacture of the CRT. The correction data is generated by measuring a distortion amount of an image displayed on the CRT, a misconvergence amount, or the like.

An apparatus for generating correction data is constructed by including, for example, an image pickup apparatus 64 for obtaining an image displayed on the CRT and correction data generating means (not shown) for generating correction data on the basis of an image obtained by the image pickup apparatus 64. The image pickup apparatus 64 is constructed by including an image pickup device such as a CCD (charge coupled device), picks up an image of each of R, G, and B displayed on the tube screen 11B of the CRT with respect to the right and left split picture planes, and outputs the picked up image for each color as image data. The correction data generating means is constructed by a microcomputer or the like and generates, as correction data, data indicative of a shift amount from a proper display position of each pixel in two-dimensional discrete image data indicative of an image picked up by the image pickup apparatus 64. For an apparatus for generating correction data and a process for correcting an image by using the correction data, the invention (Japanese Patent Laid-open No. 2000-138946) applied by the inventor herein can be used.

As each of the DSP circuits 50R and 50L for intensity control and the DSP circuits 55 (55L1, 55L2, 55R1, and 55R2) for position correction, for example, a general one-chip LSI (Large Scale Integrated circuit) and the like is used. The DSP circuits 50R, 50L, and 55 correct intensity in the overlapped area OL and raster distortion, misconvergence, and the like of the CRT. Particularly, the control unit 62B instructs a computing method for correcting the position to each of the DSP circuits 55 for position correction on the basis of the correction data stored in the correction data memory 60.

The DSP circuit 50L performs a signal process regarding mainly intensity on image data for the left-side split picture plane in the image data of each color stored in the frame memory 53 and outputs the processed image data of each color to the DSP circuit 55L1. The DSP circuit 55L1 performs positional correction in the lateral direction on image data of each color output from the DSP circuit 50L, and outputs the result of each color to the frame memory 56L. The DSP circuit 55L2 performs positional correction in the vertical direction on image data of each color stored in the frame memory 56L, and outputs the result of each color to the D/A converter 57L.

The DSP circuit 50R performs a signal process regarding intensity on image data for the right-side split picture plane in the image data of each color stored in the frame memory 53 and outputs the corrected image data of each color to the DSP circuit 55R1. The DSP circuit 55R1 performs a process of positional correction in the lateral direction on image data of each color output from the DSP circuit 50R, and outputs the result of the correction of each color to the frame memory 56R. The DSP circuit 55R2 performs a process of positional correction in the vertical direction on image data of each color stored in the frame memory 56R, and outputs the result of the correction of each color to the D/A converter 57R.

The DSP circuits 50R and 50L for intensity control and the control unit 62A can modulate the intensity of the video signal in accordance with the pixel position and the signal level. The signal process performed by the DSP circuits 50R and 50L and the control unit 62A is, for example as will be described hereinlater, a process of multiplying the video signal by a correction factor for changing the magnitude of intensity.

The D/A converter 57L converts the corrected image data for the left-side electron beam output from the DSP circuit 55L2 into an analog signal of each color and outputs the analog signal to a corresponding cathode group in the left-side electron gun 31L. On the other hand, the D/A converter 57R converts the corrected image data for the right-side electron beam output from the DSP circuit 55R2 into an analog signal of each color and outputs the analog signal to a corresponding cathode group in the right-side electron gun 31R.

The frame memories 56R and 56L two-dimensionally store the computed image data of each color output from the DSP circuits 55R1 and 55L1 on the frame unit basis and output the stored image data color by color. The frame memories 56R and 56L are memories, which can be accessed at random at high speed. For example, an SRAM (static RAM) or the like is used as each of the frame memories 56R and 56L.

The memory controller 63 can generate the read addresses of image data stored in the frame memories 56R and 56L in accordance with an order different from an order of write addresses. The DSP circuit is generally suitable for a computing process in one direction. In the embodiment, the DSP circuit can properly convert image data so that an image suited to the computing characteristics of the DSP circuit is obtained.

The operation of the CRT having such the configuration will now be described.

First, general operations of the CRT will be described. The analog composite signal one-dimensionally input as the video signal $D_{IN}$ is converted into an image signal of each of R, G, and B colors by the composite RGB converter 51 (FIG. 5). The image signal is converted to a digital image signal of each color by the A/D converter 52. It is preferable to perform IP (interlace progressive) conversion at this time, since the following process will be facilitated. The digital image signal of each color output from the A/D converter 52 is stored color by color in the frame memory 53 on the frame unit basis in accordance with a control signal Sa1 indicative of the write address generated by the memory controller 54. The pixel data in the frame unit stored in the frame memory 53 is read according to a control signal Sa2 indicative of a read address generated by the memory controller 54, and is output to the DSP circuits 50R and 50L for intensity control and the control unit 62A.

The image data for the left-side split picture plane in the image data of each color stored in the frame memory 53 is subjected to a signal process regarding intensity on the basis of the signal processing method instructed by the control unit 62A by the action of the DSP circuit 50L. After that, the processed image data is subjected to a computing process for correcting the position of the image on the basis of the correction data stored in the correction data memory 60 by the actions of the DSP circuit 55L1, frame memory 56L, and DSP circuit 55L2. The image data for the left-side split picture plane after the computing process is converted to an analog signal via the D/A converter 57L and the analog signal is supplied as a cathode drive voltage to a not-illustrated cathode disposed on the inside of the left-side electron gun 31L.

On the other hand, the image data for the right-side split picture plane out of the image data of each color stored in the frame memory 53 is subjected to the signal process related to intensity on the basis of the signal processing method instructed by the control unit 62A by the action of the DSP circuit 50R. After than, the processed image data is subjected to a computing process for correction the position of the image on the basis of the correction data stored in the correction data memory 60 by the actions of the DSP circuit 55R1, frame memory 56R, and DSP circuit 55R2. The image data for the right-side split picture plane after the computing process is converted to an analog signal via the D/A converter 57R and the analog signal is supplied as a cathode drive voltage to a not-illustrated cathode disposed on the inside of the right-side electron gun 31R.

The electron guns 31R and 31L emit the electron beams 5R and 5L in accordance with the supplied cathode drive voltage. The CRT in the embodiment can display a color image. In practice, each of the electron guns 31R and 31L is provided with the cathodes for R, G, and B and the electron beams for R, G, and B are emitted from each of the electron guns 31R and 31L.

The left-side electron beam 5L emitted from the electron gun 31L and the right-side electron beam 5R emitted from the electron gun 31R pass through the color selection mechanism 12 and are irradiated to the phosphor screen 11A. The electron beams 5R and 5L are converged by the electromagnetic action of the convergence yokes 32R and 32L and deflected by the electromagnetic action of the deflection yokes 21R and 21L, respectively. By the actions, the entire phosphor screen 11A is scanned with the electron beams 5R and 5L and a desired image is displayed in the picture plane SA (FIG. 3) in the tube screen 11B of the panel portion 10. More specifically, an image in almost the left half of the screen is formed by the left-side electron beam 5L and an image in almost the right half of the screen is formed by the right-side electron beam 5R. By connecting the ends of the split right and left picture planes formed by the scan with the electron beams 5R and 5L so as to be partially overlapped with each other, the single picture plane SA is formed as a whole.

A concrete example of the computing process on the image data performed in the CRT will now be described.

First, by referring to FIGS. 6A to 6E, the general flow of the image data correcting process performed by the processing circuit illustrated in FIG. 5 will be described. Since the correcting process performed on the image data for the right-side split picture plane and that performed on the image data for the left-side split picture plane are substantially the same, the computing process executed on the image data for the left-side split picture plane will be mainly representatively described hereinbelow. As an example of the computing process, a process of performing a line scan with each of the electron beams 5R and 5L in the vertical direction from top to bottom as shown in FIG. 4 and horizontally executing a field scan in opposite directions from the center portion of the screen towards the outside will be described.

Figures 6A, 6B, 6C, 6D, 6E:
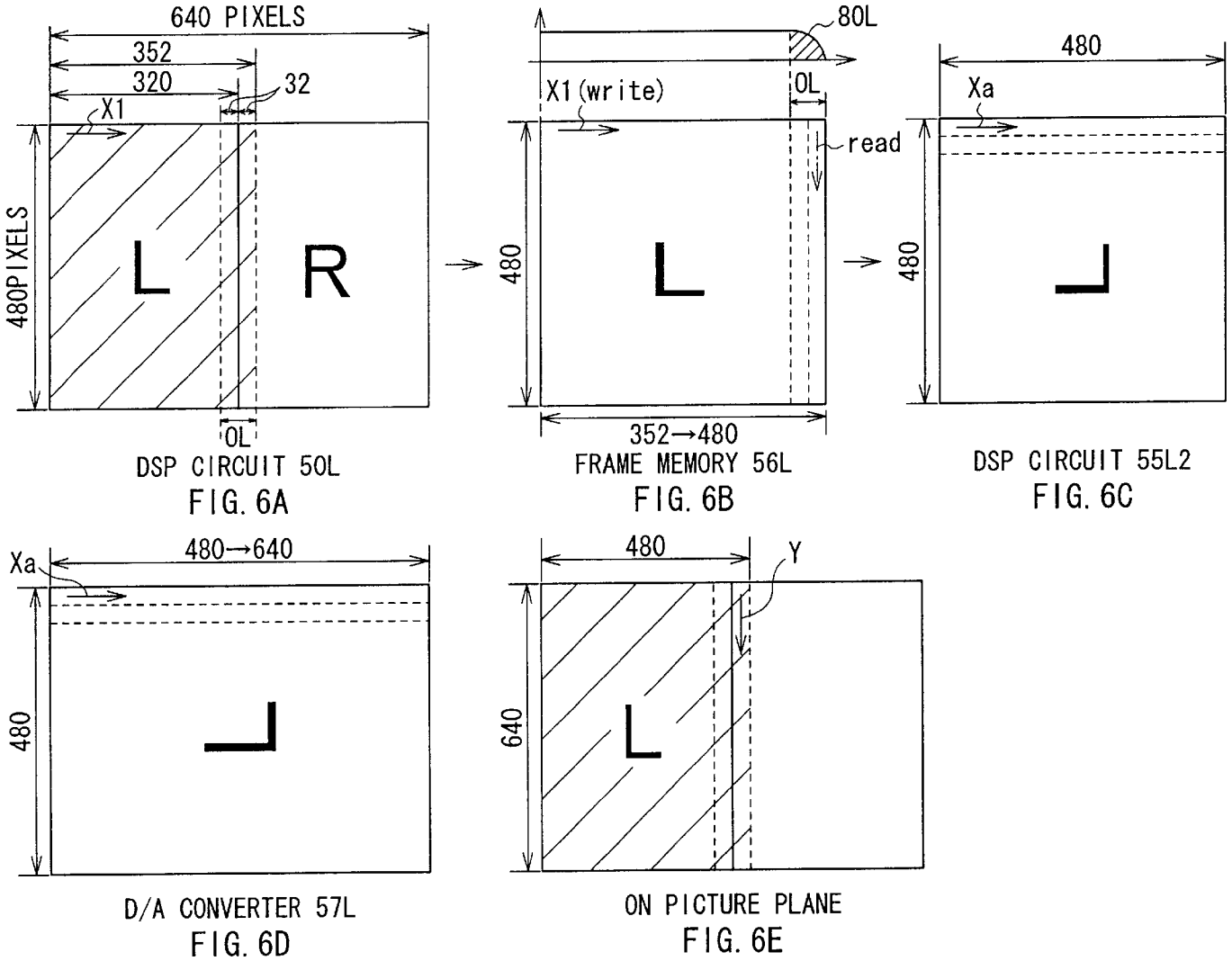
FIGS. 6A to 6E are explanatory diagrams showing a concrete example of a computing process performed on image data for a left-side split picture plane in the processing circuit illustrated in FIG. 5.

FIG. 6A shows image data for the left-side split picture plane read from the frame memory 53 and input to the DSP circuit 50L. In the frame memory 53, for example, image data of 640 pixels in the horizontal direction and 480 pixels in the vertical direction is written. Out of the image data of 640 pixels in the horizontal direction and 480 pixels in the vertical direction, for example, a central area of 64 pixels in the horizontal direction (32 pixels on the left side +32 pixels on the right side) and 480 pixels in the vertical direction is the overlapped area OL of the right and left split picture planes. In the DSP circuit SOL, out of the image data written in the frame memory 53, as shown by a hatched area in Fig. GA, data of 352 pixels in the horizontal direction and 480 pixels in the vertical direction on the left side is sequentially read in the right direction (X1 direction in the drawing) from the upper left pixel as a starting point and input.

FIG. 6B schematically shows image data to be written into the frame memory 56L, which has been corrected by the DSP circuits 50L and 55L1. Before the correcting process is performed by the DSP circuit 55L1, the DSP circuit 50L executes the computing process for correcting the intensity in the overlapped area OL independent of the positional correction on the data of 352 pixels in the horizontal direction and 480 pixels in the vertical direction shown by the hatched area in FIG. 6A. FIG. 6B also shows an example of a modulation waveform 80L indicative of correction of intensity in the left-side split picture plane so as to correspond to the image data.

On the other hand, after the intensity correcting process is performed by the DSP circuit 50L, the DSP circuit 55L1 performs the computing process accompanying correction in the horizontal direction on data having 352 pixels horizontally by 480 pixels vertically illustrated by the hatched area in FIG. 6A. By the computing process, as shown in FIG. 6B, for example, the image is enlarged in the horizontal direction from 352 pixels to 480 pixels, thereby generating image data having 480 pixels horizontally by 480 pixels vertically. The DSP circuit 55L1 enlarges the image and simultaneously performs the computing process for correcting raster distortion in the lateral direction and the like on the basis of the correction data stored in the correction data memory 60. To increase the number of pixels, data related to pixels that do not exist in the original image has to be interpolated. As the method of converting the pixel numbers, for example, the methods disclosed in patent specifications (Japanese Patent Laid-open No. Hei 10-124656, Japanese Patent Laid-open No. 2000-333102, and the like) applied by the inventor herein can be used.

In the frame memory 56L, the image data subjected to the computing processes by the DSP circuits 50L and 55L1 is stored color by color in accordance with a control signal Sa3L indicative of a write address generated by the memory controller 63. In the example of FIG. 6B, image data is sequentially written in the horizontal direction (X1 direction in the drawing) from the upper left pixel as a starting point. The image data stored in the frame memory 56L is read color by color in accordance with a control signal Sa4L indicative of a read address generated by the memory controller 63 and input to the DSP circuit 55L2. In the embodiment, the order of the write address and that of the read address to the frame memory 56L generated by the memory controller 63 are different from each other. In the example of FIG. 6B, the image data is sequentially read in the vertical direction (Y1 direction in the drawing) from the upper right pixel as a starting point.

FIG. 6C schematically shows the image data read from the frame memory 56L and input to the DSP circuit 55L2. As described above, in the embodiment, read addresses to the frame memory 56L are read downward from the upper right pixel as a starting point, so that an image input to the DSP circuit 55L2 is transformed so as to turn counterclockwise by 90° from the image illustrated in FIG. 6B.

The DSP circuit 55L2 performs the computing process accompanying the correction in the vertical direction on the data (FIG. 6C) having 480 pixels horizontally by 480 pixels vertically read from the frame memory 56L and outputs the resultant to the D/A converter 57. By the computing process, as shown in FIG. 6D, for example, the image in the horizontal direction is enlarged from 480 pixels to 640 pixels, thereby generating image data of 640 pixels in the horizontal direction and 480 pixels in the vertical direction. Simultaneously with the enlargement of the image, the DSP circuit 55L2 performs the computing process for correcting raster distortion in the vertical direction and the like on the basis of the correction data stored in the correction data memory 60. Since the image data input to the DSP circuit 55L2 has been turned by 90°, the computing process is performed in the horizontal direction (Xa direction in the drawing) on the DSP circuit 55L2. When the state of the original image is used as a reference, however, the computing process is performed, actually, in the vertical direction.

By making a scan with the left-side electron beam 5L on the basis of the image data (FIG. 6D) obtained by the computing processes as described above, an image is properly displayed without raster distortion or the like in the left-side split picture plane. Simultaneously, a similar computing process is performed on the image data for the right-side split picture plane and a scan is made with the right-side electron beam 5R, thereby properly displaying an image without raster distortion or the like on the right-side split picture plane. Consequently, an image is properly displayed on the right and left split picture planes so that the joint portion is made inconspicuous.

Out of computing processes performed on the image data in the CRT, the process for making mainly positional correction will be described.

Figures 7A, 7B, 7C:
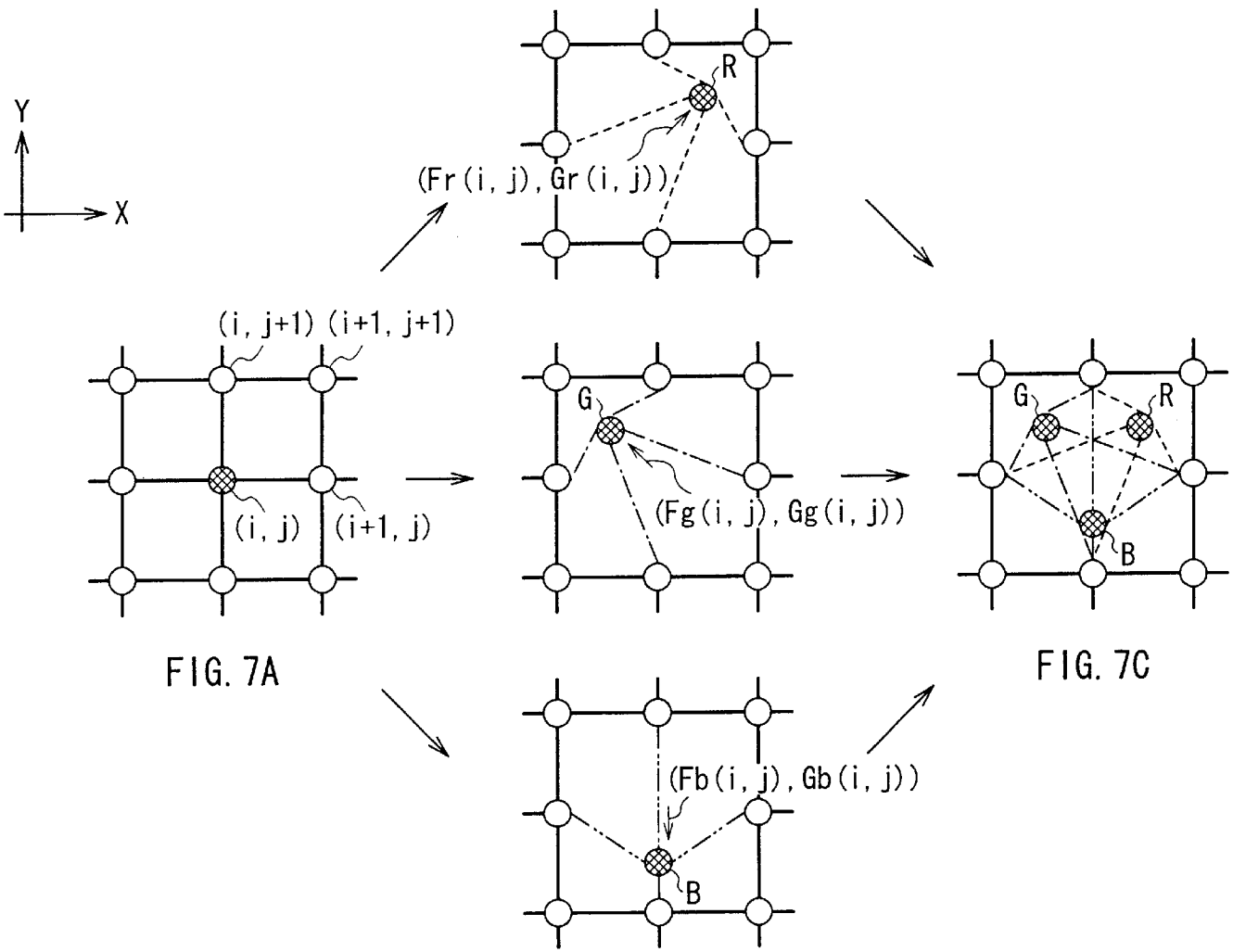
FIGS. 7A to 7C are explanatory diagrams showing the outline of data for correction used in the processing circuit illustrated in FIG. 5.

First, by referring to FIGS. 7A to 7C, the outline of correction data (to be stored in the correction data memory 60 (FIG. 5)) mainly used for making positional correction will be described. The correction data is expressed by, for example, a shift amount from points as references disposed in a lattice state. For example, when a lattice point (i, j) shown in FIG. 7A is set as a reference point, a shift amount in the X direction of R color is expressed as Fr(i, j), a shift amount in the Y direction of R color is expressed as Gr(i, j), a shift amount in the X direction of G color is expressed as Fg(i, j), a shift amount in the Y direction of G color is expressed as Gg(i, j), a shift amount in the X direction of B color is expressed as Fb(i, j) and a shift amount in the Y direction of B color is expressed as Gb(i, j), the pixels of R, G, B colors at the lattice point (i, j) are shifted only by the shift amounts as shown in FIG. 7B. By combining images shown in FIG. 7B, an image as shown in FIG. 7C is obtained. When an image obtained in such a manner is displayed on the tube screen 11B, due to the influences of characteristics of raster distortion of the CRT itself, the earth's magnetic field, and the like, misconvergence and the like are corrected as a result, and the pixels of R, G, and B are displayed on the same point on the tube screen 11B. In the processing circuit shown in FIG. 5, for example, correction based on the shift amount in the X direction is performed by the DSP circuits 55L1 and 55R1, and correction based on the shift amount in the Y direction is performed by the DSP circuits 55L2 and 55R2.

The positional computing process using the correction data will now be described. For simplicity of explanation, in some cases, correction of an image will be described with respect to both the vertical and horizontal directions. However, as described above, the signal processing circuit shown in FIG. 5 corrects an image separately in the vertical direction and the horizontal direction.

Figure 8A:
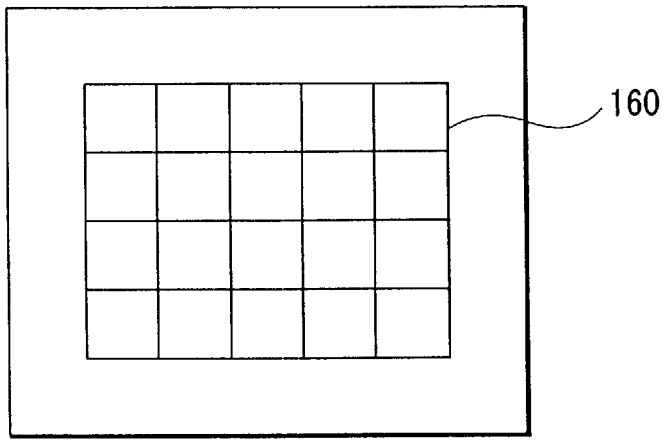
FIGS. 8A to 8C are explanatory diagrams showing a state of deformation of an input image in the case where a correcting operation using the data for correction is not performed in the processing circuit illustrated in FIG. 5.
Figure 8B:
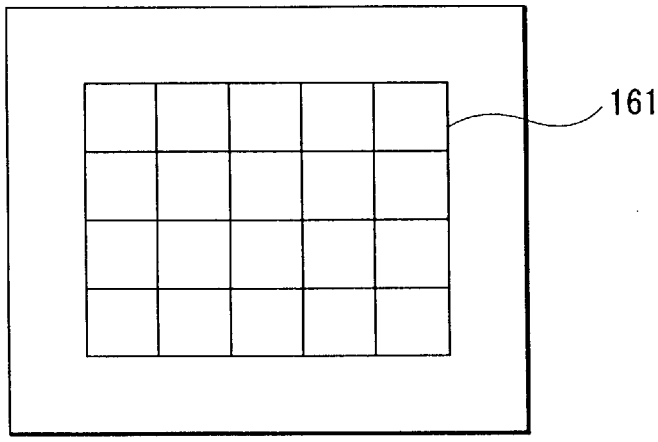
Figure 8C:
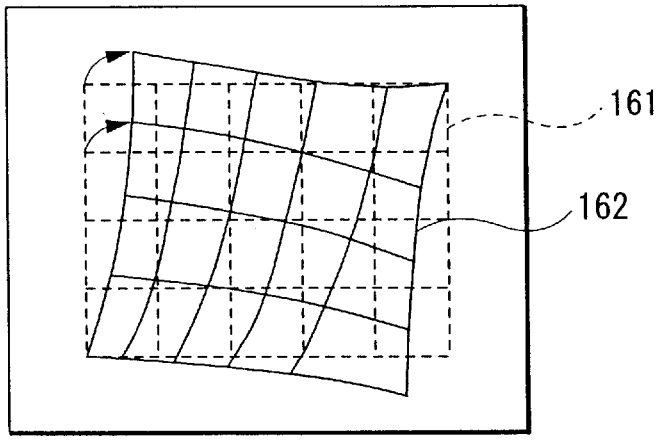
Figure 9A:
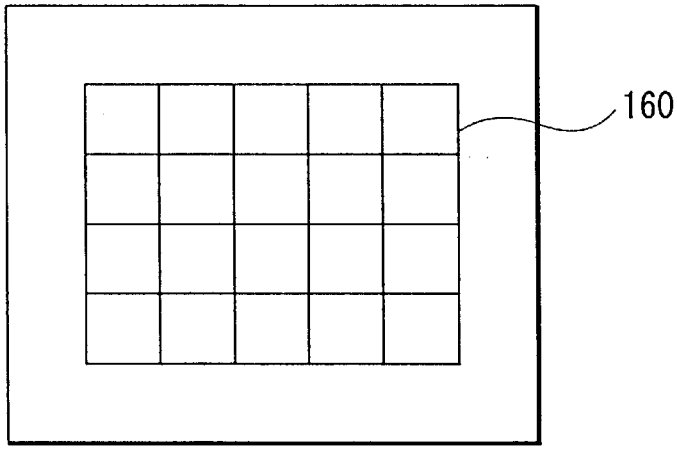
FIGS. 9A to 9C are explanatory diagrams showing a state of deformation of an input image in the case where the correcting operation using the data for correction is performed in the processing circuit illustrated in FIG. 5.
Figure 9B:
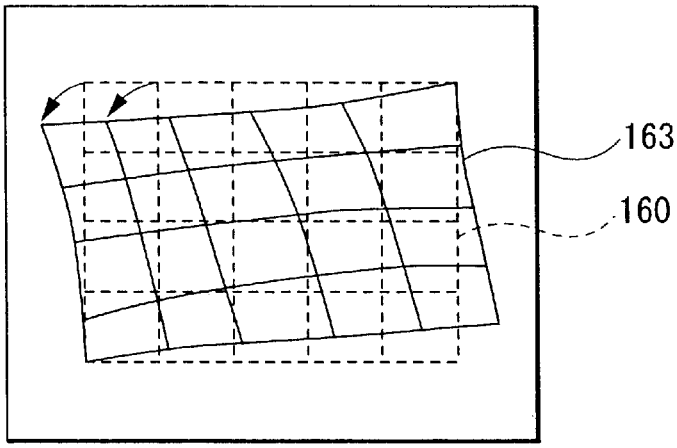
Figure 9C:
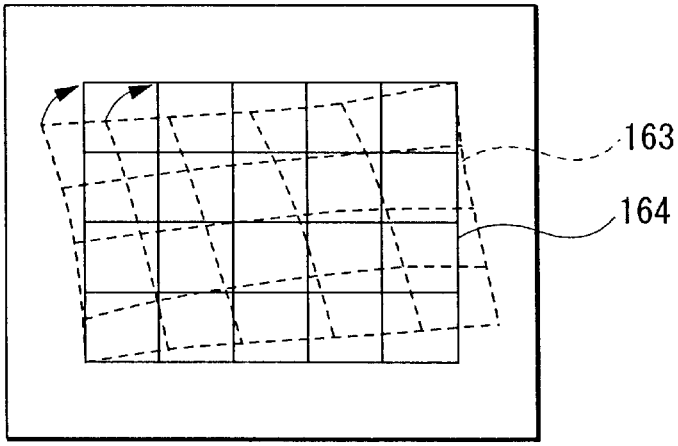

FIGS. 8A to 8C and FIGS. 9A to 9C show states where an input image is deformed in the processing circuit illustrated in FIG. 5. An example where a lattice-shaped image is input as an input image is shown here. Each of FIGS. 8A and 9A shows the right or left-side split picture plane on the frame memory 53. Each of FIGS. 8B and 9B shows an image which is input via the DSP circuit 55R1 or 55L1 and is output from the DSP circuit 55R2 or 55L2. Each of FIGS. 8C and 9C shows an image of the left or right-side split picture plane actually displayed on the tube screen 11B.

FIGS. 8A to 8C show a deformation state of an input image in the case where the positional correcting operation using the correction data is not performed in the processing circuit shown in FIG. 5. In the case where the correcting operation is not performed, each of an image 160 (FIG. 8A) on the frame memory 53 and an image 161 (FIG. 8B) output from the DSP circuit 55R2 or 55L2 has the same shape as the input image. After that, the image is distorted by the characteristics of the CRT itself. For instance, a deformed image 162 as shown in FIG. 8C is displayed on the tube screen 11B. An image illustrated by broken lines in FIG. 8C corresponds to an image to be displayed inherently. A phenomenon that images of R, G, and B deform in the same manner in the process of displaying an image is raster distortion. A case where images of R, G, and B deform differently corresponds to misconvergence. In order to correct the image distortion as shown in FIG. 8C, it is sufficient to deform the image in the directions opposite to the characteristics of the CRT before an image signal is input to the CRT.

FIGS. 9A to 9C show a change in the input image in the case where the positional correcting operation is performed in the processing circuit illustrated in FIG. 5. The positional correcting operation is performed for each of R, G, and B colors. In the correcting operation, although the correction data used for the operation varies according to the colors, the same computing method is used for the R, G, B colors. Also in the case of performing the correcting operation, the image 160 (FIG. 9A) on the frame memory 53 has the same shape as that of an input image. An image stored in the frame memory 53 is subjected to the correcting operation so that the image is deformed in the direction opposite to the deformation which occurs in the input image in the CRT (deformation according to the characteristics of the CRT, see FIG. 8C) on the basis of the correction data by the DSP circuits 55L1, 55L2, 55R1, and 55R2. FIG. 9B shows an image 163 after the operation. In FIG. 9B, an image illustrated by broken lines is the image 160 on the frame memory 53 and corresponds to an image which has not be subjected to the correcting operation. A signal of the image 163 formed in the direction opposite to the characteristics of the CRT is further distorted by the characteristics of the CRT as described above. As a result, an ideal image 164 (FIG. 9C) having a shape similar to that of the input image is displayed on the tube screen 11B. In FIG. 9C, an image illustrated by broken lines corresponds to the image 163 shown in FIG. 9B.

Figure 10:
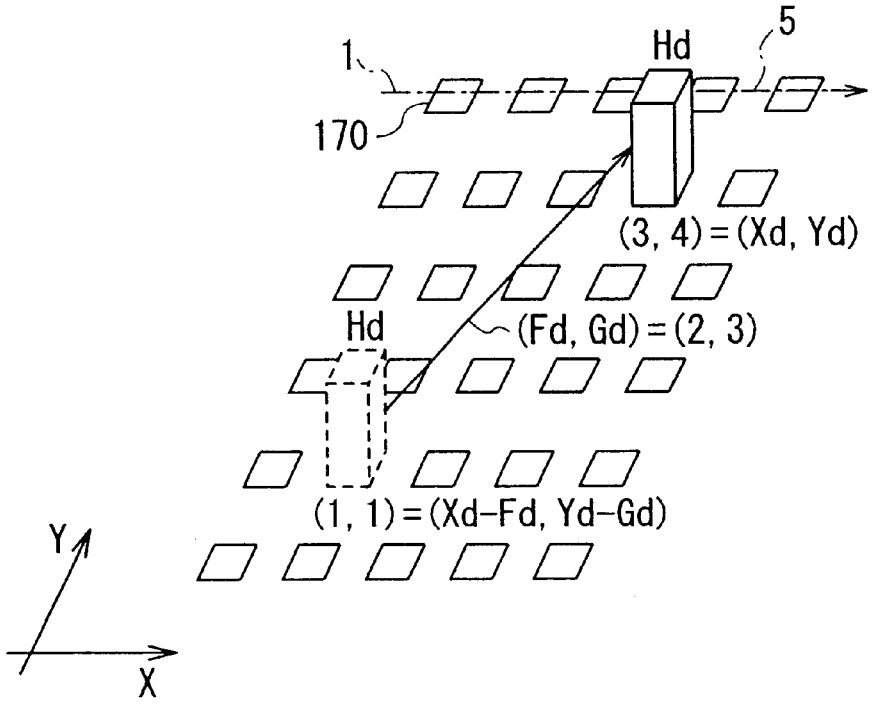
FIG. 10 is an explanatory diagram showing an example of a computing process for correcting an arrangement state of pixels in image data.

The positional correcting operation performed by the DSP circuits 55 (DSP circuits 55L1, 55L2, 55R1, and 55R2) will be described more specifically. FIG. 10 is an explanatory diagram showing an example of the correcting operation performed by the DSP circuit 55. In FIG. 10, an image 170 is disposed in a lattice state on integer positions of an XY coordinate system. FIG. 10 shows, as an example of the operation in the case where attention is paid only to one pixel, a state where a value Hd of an R signal (hereinbelow, called "R value") as the value of a pixel which was in the coordinates (1, 1) before the correcting operation by the DSP circuit 55 is performed shifts to the coordinates (3, 4) after the operation. In FIG. 10, a portion illustrated by broken lines shows the R value (pixel value) before the correcting operation. When the shift amount of the R value is expressed by a vector (Fd, Gd), (Fd, Gd)=(2, 3). This will now be seen from the pixel after the operation. When the pixel is in the coordinates (Xd, Yd), it can be also interpreted that the value is a copy of the R value Hd in the coordinates (Xd−Fd, Yd−Gd). By performing such a copying operation on all the processed pixels, an image to be outputted as a display image is completed. Therefore, the correction data stored in the correction data memory 60 may be a shift amount (Fd, Gd) corresponding to each processed pixel.

The relation of the shift of the pixel value described above will now be explained in association with a scan on the screen of the CRT. Usually, in the CRT, a scan with the electron beam 5 in the horizontal direction is performed in the direction from left to right of the screen (X direction in FIG. 10), and a scan in the vertical direction is performed from top to bottom of the screen (−Y direction in FIG. 10). In the arrangement of pixels as shown in FIG. 10, when the scan based on the original video signal is performed, the pixel in the coordinates (1, 1) is scanned after the pixel in the coordinates (3, 4). In the case of the scan based on the video signal subjected to the correcting operation by the DSP circuit 55 in the embodiment, however, the pixel in the coordinates (1, 1) in the original video signal is scanned "before" the pixel in the coordinates (3, 4) in the original video signal. In the embodiment, as described above, the correcting operation of rearranging the arrangement state of pixels in the two-dimensional image data on the basis of the correction data or the like and, as a result, changing the original one-dimensional video signal in time and space on the pixel unit basis is performed.

A process of intensity modulation control performed by the DSP circuits 50R and 50L and the control unit 62A as the characteristic parts of the embodiment will now be described in detail.

The CRT can perform the intensity modulation control according to the signal level (intensity level) with respect to each of pixel positions in the overlapped area. In the CRT, the intensity modulation control is performed by using a first correction factor and a second correction factor. The first correction factor is associated with the signal level of a video signal and a pixel position in the direction orthogonal to the direction of overlapping the plurality of split picture planes. The second correction factor is associated with the signal level of a video signal and a pixel position in the direction of overlapping the plurality of split picture planes.

Figure 12:
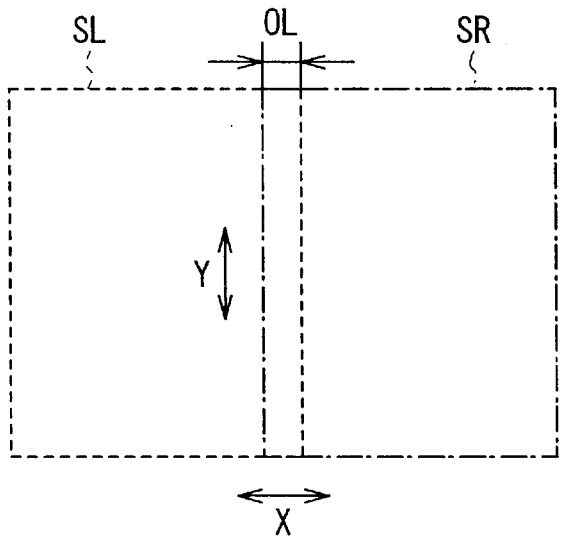
FIG. 12 is an explanatory diagram for explaining an overlapping direction in an overlapped area of two split picture planes.
Figure 13:
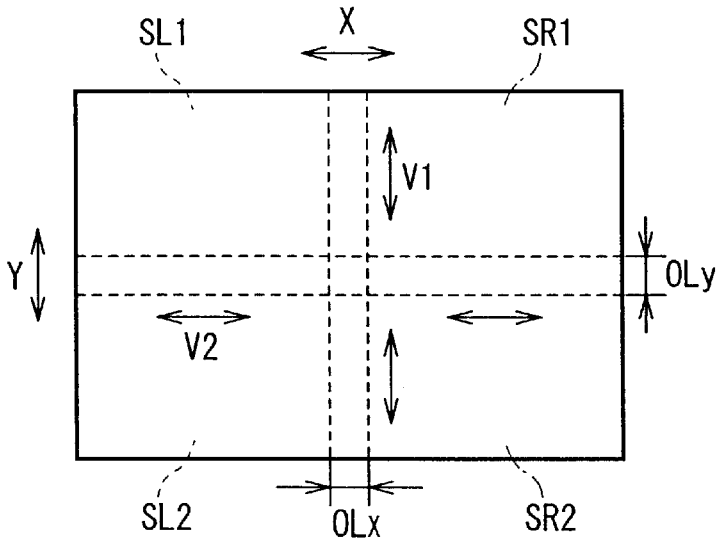
FIG. 13 is an explanatory diagram for explaining the overlapping direction in an overlapped area of four split picture planes.

The relation between the method of overlapping the plurality of split picture planes and "the direction orthogonal to the overlapping direction" will be described. For example, in the case of overlapping the two split picture planes SL and SR with each other in the horizontal direction X, as shown in FIG. 12, the vertical direction Y orthogonal to the direction X is the "direction orthogonal to the overlapping direction (hereinbelow, also simply called an orthogonal direction)". For example, in the case of overlapping four split picture planes SL1, SL2, SR1, and SR2 in the vertical direction (direction Y) and the horizontal direction (direction X) as shown in FIG. 13, with respect to an overlapped area OLx formed by overlapping the split picture planes in the horizontal direction, the direction Y (V1) is the "orthogonal direction". On the other hand, with respect to an overlapped area OLy formed by overlapping the split picture planes in the vertical direction, the X (V2) direction is the "orthogonal direction".

In the following, as shown in FIGS. 11A and 11B, the case of inputting a video signal having, for example, 720 pixels horizontally by 480 pixels vertically and forming the right and left split picture planes SR and SL so as to be overlapped with each other in the central area of 48 pixels in the horizontal direction and 480 pixels in the vertical direction indicated by the input video signal will be described. That is, as shown in FIG. 11B, the case where the video signal of 384 pixels in the horizontal direction and 480 pixels in the vertical direction is input to each of the DSP circuits 50R and 50L will be described. In FIGS. 11A and 11B, a reference numeral 01 denotes the center line of the whole screen area.

The DSP circuits 50R and 50L and the control unit 62A perform the modulation control so as to change the intensity level in a curved shape to make the intensity incline by gradually increasing the intensity level from the start points P1L and P1R of the overlapped area OL in the split picture planes SR and SL as shown in FIG. 11C for example so as to become the maximum at end points P2R and P2L of the overlapped area OL. After that, that is, in the area other than the overlapped area OL, the magnitude of intensity is modulated so that the intensity level is constant until the ends of the screen. The modulation control is performed so as to satisfy the above-described equations (4) and (5). When such a control is performed both in the split picture planes SR and SL so that the sum of intensity values in the two picture planes becomes equal to the intensity in the same pixel position in the original image in an arbitrary pixel position in the overlapped area OL, the joint of the picture planes can be made inconspicuous from a viewpoint of intensity. FIG. 11C shows the intensity levels in correspondence with the pixel positions in the split picture planes shown in FIG. 11B. In FIG. 11C, as an example, the maximum intensity level is set as 1 and the minimum level is set as 0.

The intensity gradient in the overlapped area OL can be realized in, for example, the shape of a sine or cosine function or the shape of a curve of the second order. By optimizing the shape of the intensity gradient, the intensity change in the overlapped area OL can be seen more naturally, and the margin can be widened for a positional error in overlapping of the right and left split picture planes SR and SL.

Figure 1A:
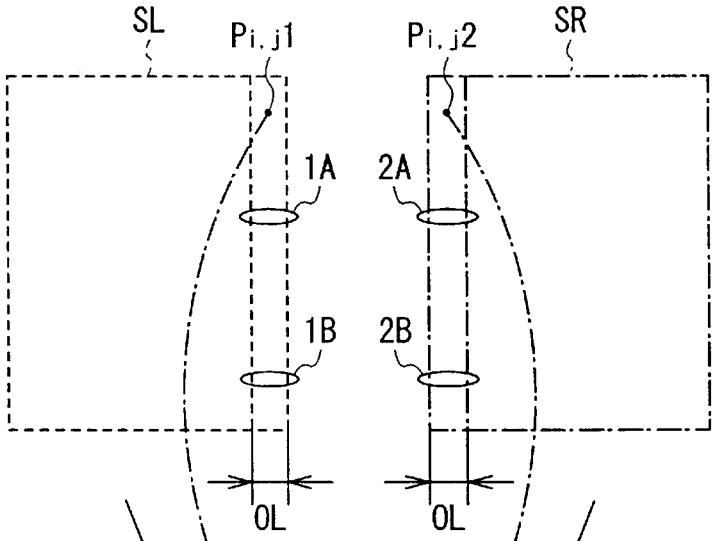
FIG. 1A RELATED ART
FIGS. 1A and 1B are diagrams for explaining an example of a method of overlapping a plurality of split picture planes and variations in intensity in an overlapped area of the picture planes.
Figure 1B:
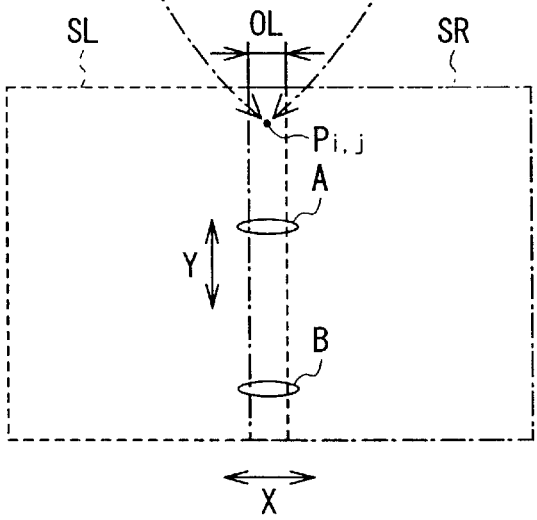
FIG. 1B RELATED ART
Figure 2:
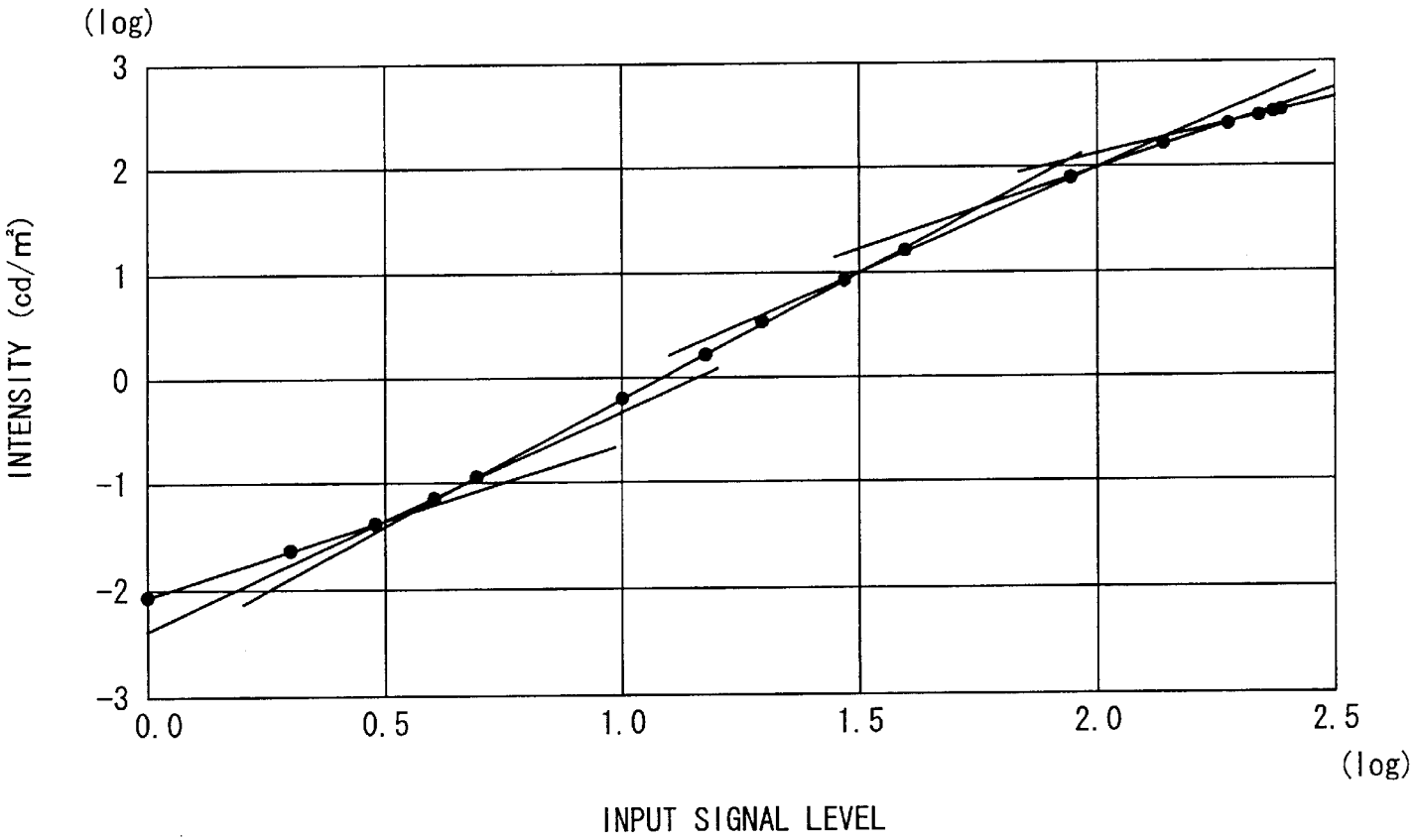
FIG. 2 RELATED ART
FIG. 2 is a characteristic diagram for explaining a gamma value.

Generally, one of factors that determine the magnitude of the intensity in the CRT is a gamma value. The gamma value varies according to the level of the input video signal as described by using FIG. 2. In order to join the right and left split picture planes with higher accuracy without causing intensity unevenness, the intensity control according to the signal level of the video signal has to be performed.

A concrete example of the correction factor used for the intensity modulation control will now be described.

FIGS. 14 and 15 show a concrete example of the correction factors (second correction factors) in the overlapping direction. FIG. 14 shows factors for the left-side split picture plane, and FIG. 15 shows factors for the right-side split picture plane. In the CRT, as stated above, the magnitude of intensity is controlled so as to achieve the intensity gradient in, for example, the sine or cosine function shape in the overlapping direction in the overlapped area OL. The intensity gradient is realized in practice by multiplying the video signal by a correction factor k1 or k2 according to a pixel position in each of the right and left split picture planes as expressed by the equations (2) and (3). In the CRT, even if the video signal is in the same pixel position, the correction factor which varies according to the level of the video signal is used.

The correction factors shown in FIGS. 14 and 15 are actually stored in the memory in the control unit 62A as a program in a table format. The table related to the correction factors shown in the drawing may be stored in a memory separately provided for storing the table of the correction factors on the outside of the control unit 62A. In FIGS. 14 and 15, for example, "cram WRx0" denotes a correction factor group applied to video signals for R color in the pixel positions in the 0th (or 1st) line in the overlapping direction in the overlapped area OL. For example, "cram WGx0" denotes a correction factor group applied to video signals for G color in the pixel positions in the 0th line in the overlapping direction in the overlapped area OL. For example, "cram WBx0" denotes a correction factor group applied to video signals for B color in the pixel positions in the 0th line in the overlapping direction in the overlapped area OL. In this case, with respect to the pixel positions in the overlapping direction in the overlapped area OL, the position of a point P2L (P1R) shown in FIG. 11C is the pixel position in the 0th line in the overlapping direction, and the position of a point P1L (P2R) is the pixel position in the 47 (or 48)th line in the overlapping direction. The correction factor groups are prepared for all the pixel lines in the overlapping direction of the screen in the overlapped area OL. In the example shown in FIG. 11, since the number of pixels in the horizontal direction (overlapping direction) of the overlapped area OL is 48, 48 correction factors are prepared for each color.

In the example shown in FIGS. 14 and 15, correction factors associated with nine kinds of signal levels are prepared color by color for pixel lines in the overlapping direction. In the example of the diagrams, nine values inside the squiggly brackets for each color and each pixel line indicate correction factors which are numbered as first, second, . . . from the left side. A factor by which the video signal is multiplied in reality is a value obtained by multiplying each of the numerical values shown in FIGS. 14 and 15 by 1/256. That is, for instance, the value of the correction factor of 256 in FIGS. 14 and 15 is actually 1.

FIG. 16 shows an example of the corresponding relation between the correction factors shown in FIGS. 14 and 15 and the signal levels of the video signal. In the example, the intensity level of the video signal is divided into 256 levels from 0 to 255 each expressed by 8 bits. The representative intensity levels are associated with the first, second, . . . and ninth factors in accordance with the order from the lowest intensity level. Specifically, as shown in FIG. 16, the first factor is associated with the signal level 0, the second factor is associated with the signal level 32, . . . , and the ninth factor is associated with the signal level 255. The control unit 62A determines the signal level of the video signal from the corresponding relation shown in FIG. 16 and selects the correction factor corresponding to the determined signal level. The DSP circuits 50R and 50L perform the signal process for modulating the intensity of the video signal by using the correction factor selected in such a manner.

In the CRT, with respect to the overlapping direction, the correction factors associated with only the representative signal levels are pre-stored in the table format. The correction factors at the representative signal levels in the overlapping direction will be called "basic factors" hereinbelow. The table in which the basic factors are stored will be called a "basic factor table".

Although the factors at the representative signal levels are stored in the basic factor table, the factors at the other signal levels are not stored. In the embodiment, any of the factors at the other signal levels is obtained by performing the interpolating operation using the basic factor in the basic factor table. The interpolating operation is performed by using at least two basic factors most associated with the present signal level and the pixel position in the overlapping direction, which are selected from the plurality of basic factors stored in the basic factor table. An example of the concrete method of the interpolating operation is linear interpolation.

For example, as shown in FIG. 16, any of the correction factors at the signal levels from 1 to 31 is obtained by performing the interpolating operation using the first basic factor (associated with the signal level 0) and the second basic factor (associated with the signal level 32) in the basic factor table. It is now assumed as an example that the basic factor table in the X-th pixel line in the overlapping direction is set as follows.

$$cram\ WRxX=\{125, 106, \ldots\}$$

In this case, the correction factor at the signal level 10 in the X-th pixel line in the overlapping direction can be calculated by the following equation (X) in which the first and second basic factors 125 and 106 in the basic factor table are weighted by respective signal levels. A symbol "*" in the equation denotes multiplication. Such an interpolating operation is executed by, for example, the control unit 62A, thereby calculating a correction factor which is not stored in the basic factor table.

$$\text{Factor at the signal level value of } 10=\{125*(32-10)+106*(10-0)\}/(32-0)=119 \quad (X)$$

In such a manner, the correction factors of 256 gradations of each pixel line in the overlapping direction can be calculated directly or indirectly from the basic factor table. In the embodiment, further, factors for each pixel line in the orthogonal direction are prepared.

FIGS. 17 and 18 show a concrete example of the correction factors (first correction factors) in the orthogonal direction. FIG. 17 shows factors for the left-side split picture plane, and FIG. 18 shows factors for the right-side split picture plane. The correction factors shown in FIGS. 17 and 18 are referred to when a correction factor in the overlapping direction shown in FIGS. 14 and 15 is obtained, and are used to change (shift) the value of the signal level of the video signal. For example, when the actual signal level of the video signal is "255", only from the basic factor table, the factor associated with the signal level "255" is selected. When the factor value in the orthogonal direction shown in FIGS. 17 and 18 is "−1", the correction factor in the overlapping direction is shifted to the signal level 254 (=255−1). As stated above, to obtain the basic factor, by shifting the basic factor in accordance with the pixel position in the orthogonal direction by using the correction factors shown in FIGS. 17 and 18, the correction factor in an arbitrary pixel position is set. By such a method, with the minimum factor setting, the intensity modulation in the overlapping direction and the orthogonal direction can be carried out.

The correction factors shown in FIGS. 17 and 18 are stored as a program in the table format in a manner similar to the basic factor table in the memory in the control unit 62A. The table regarding the correction factors shown in the drawing may be stored by separately providing a memory for storing the table of correction factors outside of the control unit 62A. Hereinbelow, the correction factors shown in FIGS. 17 and 18 will be called "shift factors" and the table in which the shift factors are stored will be called a "shift factor table".

In FIGS. 17 and 18, for example, "cram WRY0" denotes a shift factor group applied to video signals for R color in the pixel positions in the 0th (or 1st) line in the orthogonal direction in the overlapped area OL. For example, "cram WGY0" denotes a shift factor group applied to video signals for G color in the pixel positions in the 0th line in the orthogonal direction in the overlapped area OL. For example, "cram WBY0" denotes a shift factor group applied to video signals for B color in the pixel positions in the 0th line in the orthogonal direction in the overlapped area OL. In this case, for example, the uppermost position in the screen is set as a pixel position in the 0th line, and the lowest position in the screen is set as a pixel position in the 479th line. In the embodiment, the shift factors are prepared for all the pixel lines in the orthogonal direction of the screen in the overlapped area OL. In the example shown in FIG. 11, since the number of pixels in the orthogonal direction of the overlapped area OL is 480, 480 shift factors are prepared for each color.

In the example shown in FIGS. 17 and 18, factors associated with areas at the eight signal levels are prepared for each color for the pixel lines in the orthogonal direction. In the example of the diagrams, eight values inside the squiggly brackets for each color and each pixel line indicate shift factors which are numbered as first, second, . . . from the left side.

FIG. 19 shows the corresponding relation between the shift factors shown in FIGS. 17 and 18 and the signal levels of the video signal. In the example, the intensity level of the video signal is divided into 256 levels from 0 to 255 each expressed by 8 bits. The intensity levels are classified into eight signal level areas. Specifically, the signal levels are almost equally divided into areas from 0 to 31, from 32 to 63, . . . , and from 224 to 255. The eight signal level areas are sequentially associated with the first to eighth factor numbers. The control unit 62A determines the signal level area of a video signal from the corresponding relation shown in FIG. 19 and selects the shift factor corresponding to the determined signal level area. The DSP circuits 50R and 50L shift the value of the signal level of a video signal which is referred to when the correction factor in the overlapping direction is obtained on the basis of the shift factor selected in such a manner.

Figure 20:
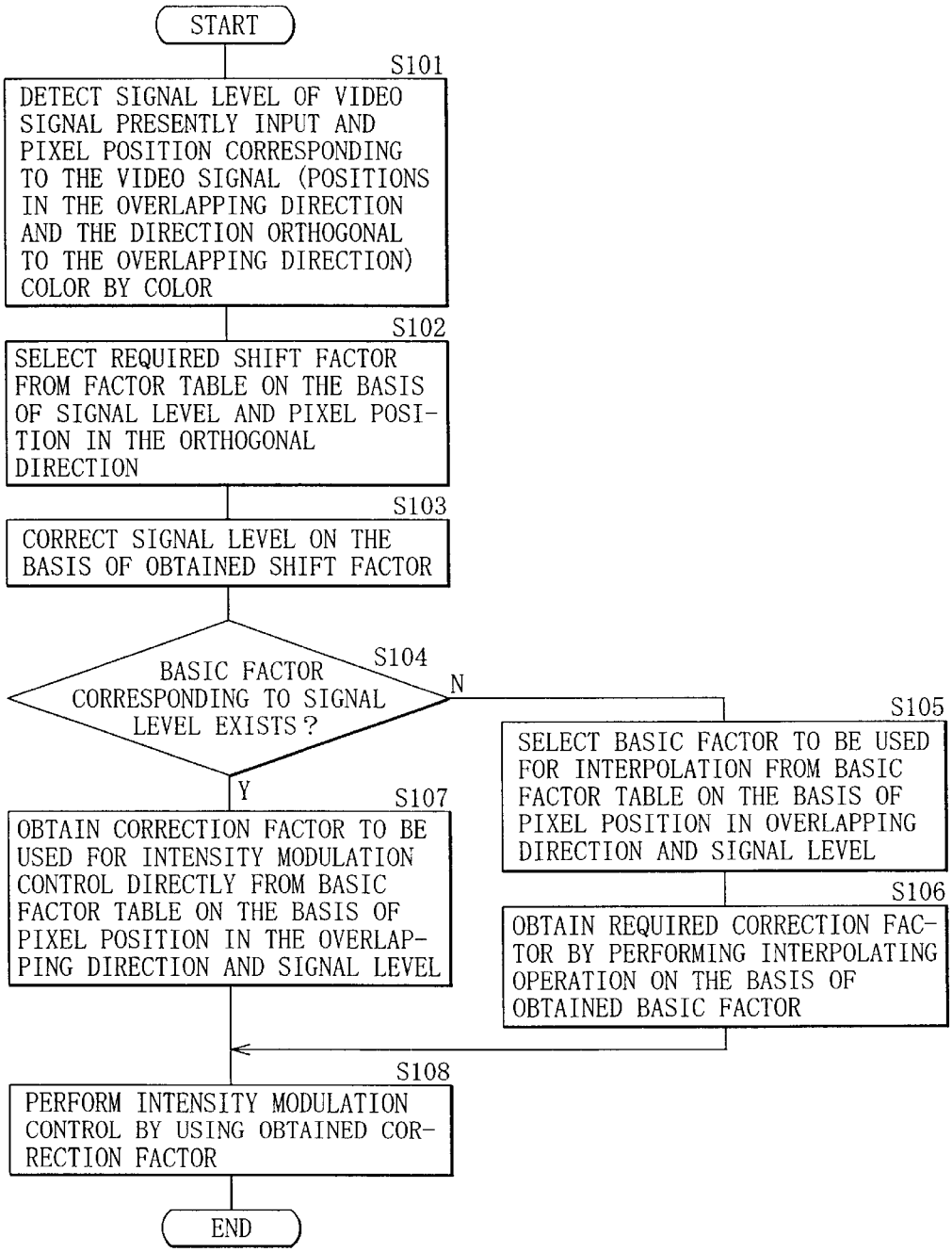
FIG. 20 is a flowchart showing a procedure of the intensity control performed in the cathode ray tube according to the first embodiment of the invention.

By referring to the flowchart of FIG. 20, the flow of the processes of the intensity control using the above-described correction factors will now be described. To the control unit 62A and the DSP circuits 50R and 50L, as shown in FIG. 5, a video signal is input from the frame memory 53. For example, at a stage where the video signal is divided into the right and left split picture planes, that is, at a stage where the video signals for the right and left split picture planes are input from the frame memory 53 to the DSP circuits 50R and 50L, the control unit 62A detects the signal level of a video signal which is input at present and the pixel position corresponding to the video signal (positions in the overlapping direction and the direction orthogonal to the overlapping direction) color by color (step S101). After that, on the basis of the detected signal level and the pixel position in the orthogonal direction, the control unit 62A refers to the shift factor table pre-stored in the memory of itself or the like and selects a necessary shift factor from the plurality of shift factors (step S102). Based on the obtained shift factor, the control unit 62A corrects the value of the signal level of the video signal which is referred to when the correction factor in the overlapping direction is obtained (step S103).

The control unit 62A determines whether the basic factor corresponding to the corrected signal level exists in the basic factor table or not (step S104). When the basic factor exits in the basic factor table (Y in step S104), the control unit 62A directly obtains the optimum correction factor to be used for the intensity modulation control from the basic factor table on the basis of the corrected signal level and the pixel position in the overlapping direction (step S107). On the other hand, when the basic factor does not exist in the basic factor table (N in step S104), the control unit 62A obtains the necessary correction factor by performing the interpolating operation. In this case, the control unit 62A first selects the basic factor used for the interpolation from the basic factor table on the basis of the corrected signal level and the pixel position in the overlapping direction (step S105). At this time, the control unit 62A selects at least two correction factors the most associated with the present signal level and the pixel position in accordance with the operating method. After that, the control unit 62A performs the interpolating operation on the basis of the obtained basic factors, thereby calculating the correction factor actually required (step S106).

After the optimum correction factor to be used for the intensity modulation control is obtained as described above, the control unit 62A instructs the DSP circuits 50R and 50L to modulate the intensity by using the obtained correction factor. The DSP circuits 50R and 50L perform the intensity modulating control using the correction factor on the video signal in accordance with the instruction of the control unit 62A (step S108). The DSP circuits 50R and 50L perform the signal process of, for example, multiplying the video signal by the correction factor as the intensity modulation control.

As described above, according to the embodiment, only the correction factors at the representative signal levels in the overlapping direction are pre-stored as the basic factor table, and the factor at any of the other signal levels is obtained by performing the interpolating operation by using the basic factor in the basic factor table. Consequently, the amount of the correction factors in the overlapping direction to be prepared can be reduced. According to the foregoing embodiment, by changing the value of the signal level of the video signal which is referred to when the correction factor in the overlapping direction is obtained by using the shift factor associated with the pixel position in the orthogonal direction, the basic factor is changed according to the pixel position in the orthogonal direction. The intensity modulation in the orthogonal direction can be therefore performed with the minimum trouble of setting the factor.

According to the embodiment, the intensity modulation control is executed according to the signal level, so that intensity unevenness can be reduced at all the gradations. Therefore, also in the case where the signal level always fluctuates like in a moving picture, the intensity can be controlled properly so that the joint portion is made inconspicuous. Since the intensity modulation control is performed color by color, the intensity unevenness caused by variations in the gamma characteristic according to the colors can be reduced. Further, the correction factor can be changed in each of the right and left split picture planes, the intensity modulation control can be performed according to the characteristics of each of the right and left electron guns 31R and 31L. Thus, the picture quality as high as or higher than that of the general single electron gun system can be realized in the in-line electron gun type CRT.

Generally, in a CRT, the spot characteristic of the electron beam varies according to a pixel position and, particularly, the spot characteristic in the central portion of the screen and that in an end portion are largely different from each other. According to the embodiment, the intensity can be modulated in the orthogonal direction. Consequently, even if there is a large difference between the spot characteristic in the central portion of the overlapped area OL and that in the upper or lower end portion, the intensity unevenness caused by the spot characteristics can be reduced. Generally, in a CRT, the light emitting characteristic of the phosphor varies according to the position in the phosphor screen 11A. In the embodiment, the intensity modulation control according to the pixel position is performed. By determining the correction factor in consideration of the light emitting characteristic of the phosphor, the intensity unevenness caused by the variations in the light emitting characteristics can be reduced. The variations in the light emitting characteristics of the phosphor can be known by measuring the light emitting amount of the phosphor, for example, at the time of manufacture of the CRT.

As described above, according to the embodiment, while suppressing the amount of factors for correcting the intensity to be prepared, the intensity correction can be performed at all the gradation levels with respect to all the pixel positions in the overlapped area. Thus, the proper intensity control by which the intensity in the joint portion is made inconspicuous can be performed.

Second Embodiment

A second embodiment of the invention will now be described. In the following description, the same components as those in the first embodiment are designated by the same reference numerals and their description will not be repeated all.

Although the shift factors for all the pixel lines in the orthogonal direction are prepared in the table format in the first embodiment, in the second embodiment, only shift factors in representative pixel positions are prepared in the table format. Any of the shift factors other than those in the representative pixel positions is obtained by performing the interpolating operation using a representative shift factor.

FIGS. 21 and 22 show an example of the shift factor table in the second embodiment. FIG. 21 shows factors for the left-side split picture plane. FIG. 22 shows factors for the right-side split picture plane. In the example of FIGS. 21 and 22, only shift factors of the amount of nine pixel lines are prepared. In FIGS. 21 and 22, for example, the numerical value just after "cram WRy" indicates the number of a representative pixel position in the orthogonal direction with respect to the R color. In the example of the drawing, for the R color, there are representative numbers of total nine pixel lines "cram WRy0" to "cram WRy8".

FIG. 23 shows an example of the corresponding relation between the representative numbers of the pixel positions in the shift factor tables shown in FIGS. 21 and 22 and the actual pixel positions in the orthogonal direction. It is assumed here that the total number of pixels in the orthogonal direction is 480. In this case, the uppermost position in the screen is set as the pixel position in the 0th line in the orthogonal direction and the lowest position in the screen is set as the pixel position in the 479th line in the orthogonal direction. As shown in FIG. 23, the representative number 0 is associated with, for example, the pixel position in the 0th line in the orthogonal direction, and the representative number 1 is associated with, for example, the pixel position in the 60th line in the orthogonal direction.

As described above, in the embodiment, with respect to the orthogonal direction, the shift factors associated with only the representative pixel positions are pre-stored in the table format. The factor in any of the positions other than the representative pixel positions is obtained by performing the interpolating operation using a shift factor stored in the shift factor table. The interpolating operation is carried out in a manner similar to the interpolating operation in the overlapping direction using the basic factor table. Specifically, out of the plurality of shift factors stored in the shift factor table, at least two shift factors most associated with the present signal level and the pixel position in the orthogonal direction are selected, and the interpolating operation such as linear interpolation is performed by using the selected shift factors.

For example, as also shown in FIG. 23, any of the shift factors in the pixel positions in the first to 59th lines in the orthogonal direction is obtained by performing the interpolating operation using the shift factors of the 0th representative number (associated with the pixel position in the 0th line) and the second representative number (associated with the pixel position in the 60th line) in the shift factor table. In the interpolating operation with respect to the overlapping direction by using the above equation (X), the factor is obtained by weighting with the signal level value. In the case of the shift factor, the factor is obtained by weighting with the value of the pixel position. Such an interpolating operation is performed by, for example, the control unit 62A to thereby calculate a shift factor which is not stored in the shift conversion table.

The corresponding relation between the factor number of the shift factor and the signal level of the video signal shown in FIGS. 22 and 23 is similar to that shown in FIG. 19.

Figure 24:
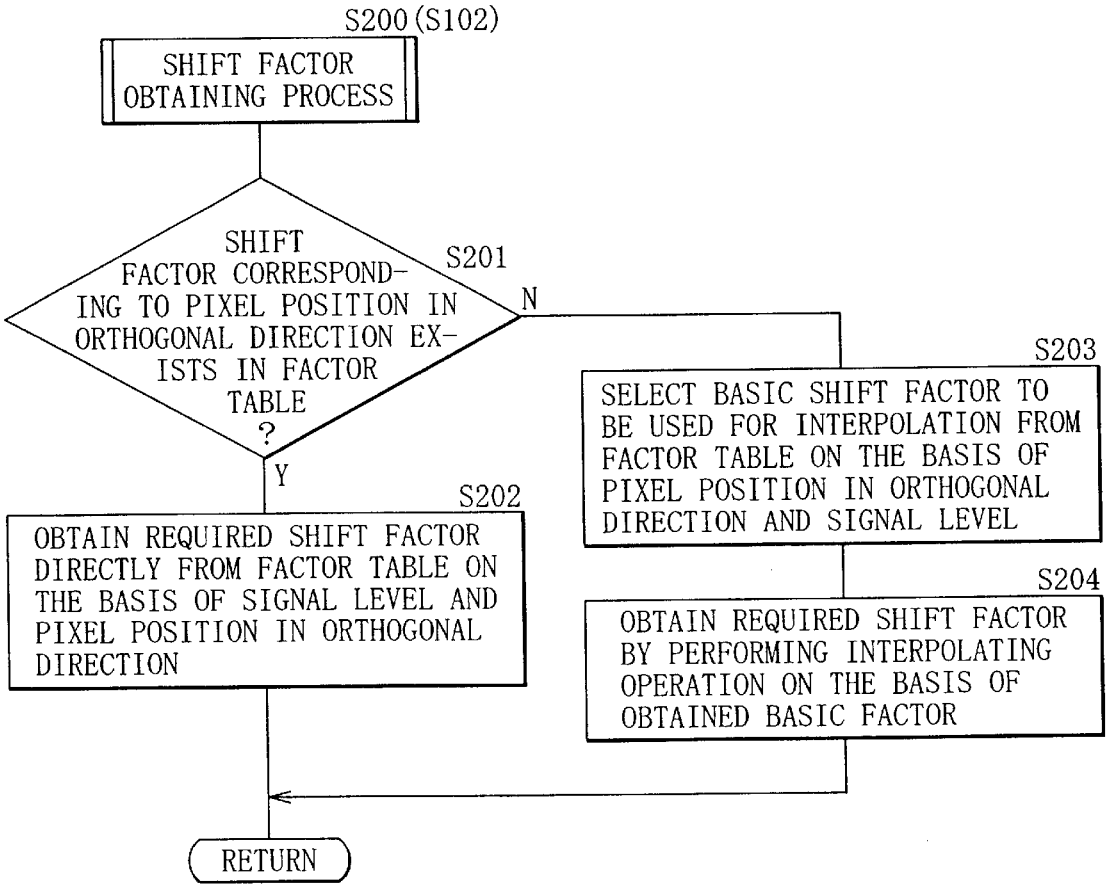
FIG. 24 is a flowchart showing a procedure of a process of obtaining the shift factor performed in the cathode ray tube according to the second embodiment of the invention.

By referring to the flowchart of FIG. 24, the flow of the processes of obtaining the shift factor in the embodiment will be described. In the embodiment, in place of the process in step S102 shown in FIG. 20, a process of obtaining the shift factor shown in FIG. 24 is performed (step S200). The other processes are similar to those shown in FIG. 20. For example, at a stage where the video signal is divided into the right and left split picture planes, that is, at a stage where the video signals of the right and left split picture planes are input from the frame memory 53 to the DSP circuits 50R and 50L, the control unit 62A detects the signal level of a video signal which is input at present and the pixel position corresponding to the video signal color by color (step S101 in FIG. 20). After that, the control unit 62A determines whether or not the shift factor corresponding to the detected signal level and the pixel position in the orthogonal direction is pre-stored in the shift factor table stored in the memory of itself or the like (step S201 in FIG. 24).

When the corresponding shift factor exists in the shift factor table (Y in step S201), the control unit 62A obtains the necessary shift factor directly from the shift factor table on the basis of the signal level and the pixel position in the orthogonal direction (step S202). On the other hand, when the shift factor does not exist in the shift factor table (N in step S201), the control unit 62A obtains the necessary shift factor by performing the interpolating operation. In this case, the control unit 62A first selects the shift factor to be used for the interpolation from the shift factor table on the basis of the signal level and the pixel position in the orthogonal direction (step S203). At this time, the control unit 62A selects at least two shift factors most associated with the signal level and the pixel position in the orthogonal direction in accordance with the operating method. After that, the control unit 62A performs the interpolating operation on the basis of the obtained shift factor, thereby calculating the shift factor actually required (step S204). After obtaining the shift factor in step S202 or S204, the control unit 62A performs the process in step S103 and the subsequent processes in FIG. 20 in a manner similar to the first embodiment.

As described above, according to the second embodiment, only the shift factors in the representative pixel positions in the orthogonal direction are pre-stored as the shift factor table, and the factor at any of the other pixel positions is obtained by performing the interpolating operation using the factor in the shift factor table. Consequently, the amount of the shift factors in the orthogonal direction to be prepared can be reduced. Thus, the amount of factors for intensity correction prepared can be reduced more than the first embodiment.

The invention is not limited to the foregoing embodiments but can be variously modified. For example, although the correction factor is properly changed according to the signal level or the pixel position in the foregoing embodiments, the correction factor can be changed according to other factor. In the CRT, for instance, the characteristic of the gamma value varies according to the characteristic of the electron gun and the like. The correction factor may be determined in consideration of the characteristic of the electron gun. The characteristic of the electron gun is, for example, the gamma characteristic of the electron gun, the current characteristic of the electron gun, or the like. The current characteristic of the electron gun includes characteristics regarding a drive voltage applied to the electron gun and the value of a current flowing in the electron gun. Generally, when the characteristics of the electron gun vary, the amount of electrons emitted varies according to the drive voltage applied to the electron gun, so that an influence is exerted on the magnitude of intensity.

Although the analog composite signal of the NTSC system is used as the video signal $D_{IN}$ in each of the foregoing embodiments, the video signal $D_{IN}$ is not limited to the signal. For example, an RGB analog signal may be used as the video signal $D_{IN}$. In this case, RGB signals can be obtained without using the composite RGB converter 51 (FIG. 5). Alternately, a digital signal as used in a digital television may be input as the video signal $D_{IN}$. In this case, a digital signal can be directly obtained without using the A/D converter 52 (FIG. 5). In any of the cases using the video signals, the circuit configuration after the frame memory 53 may be similar to that shown in the circuit example of FIG. 5.

In the circuit shown in FIG. 5, the frame memories 56R and 56L may be eliminated from the configuration and image data output from the DSP circuits 55R1 and 55L1 can be supplied to the electron guns 31R and 31L directly via the DSP circuits 55R2 and 55L2. Further, in the embodiment, the input image data is corrected in the horizontal direction and then corrected in the vertical direction. It is also possible to correct the input image data in the vertical direction and then in the horizontal direction. Further, in the embodiments, enlargement of an image is performed together with the correction of the input image data. The image data may be corrected without accompanying the enlargement of the image.

The invention can be also applied to a CRT having three or more electron guns, for forming a single picture plane by combining three or more scan picture planes. Further, the invention is not limited to the CRT but can be applied to various image displays such as a projection type image display for projecting an enlarged image formed on a CRT or the like via a projection optical system.

Further, although the intensity correcting process and the positional correcting process are separately performed in the foregoing embodiments, it is also possible to eliminate the DSP circuits 50R and 50L for intensity control from the configuration and perform the intensity process in the DSP circuits 50R and 50L simultaneously with the computing process for enlarging an image and correcting raster distortion or the like in the DSP circuits 55R1 and 55L1. Although the intensity correcting process is performed before the positional correcting process in the embodiments, it is also possible to dispose the DSP circuits 50R and 50L for intensity control at the post stage of the DSP circuits 55R2 and 55L2 and perform the intensity correcting process after the positional correcting process.

In the embodiments, the case of performing the positional correcting process by directly controlling image data in order to correct raster distortion or the like has been described. The process for correcting the raster distortion or the like may be performed by optimizing a deflected magnetic field generated by the deflection yoke. However, as described above in the embodiments, the method of directly controlling the image data by using the correction data is more preferable than the method of adjusting an image by the deflection yoke or the like, since it can reduce the raster distortion and misconvergence. In order to eliminate the raster distortion by the deflection yoke or the like, for example, it is necessary to distort the deflection magnetic field. It causes a problem such that the magnetic field becomes nonuniform, and the magnetic field deteriorates the focus (spot size) of an electron beam. In the method of directly controlling image data, however, it is unnecessary to adjust raster distortion or the like by the magnetic field of the deflection yoke, and the deflected magnetic field can be changed to the uniform magnetic field, so that the focus characteristics can be improved.

Obviously many modifications and variations of the present invention are possible in the light of the above teachings. It is therefore to be understood that within the scope of the appended claims the invention may be practiced otherwise than as specifically described.

What is claimed is:

1. A cathode ray tube for displaying an image by forming a single picture plane obtained by joining a plurality of split picture planes so as to be partially overlapped with each other, the split picture planes being formed by scan with a plurality of electron beams, comprising:

signal dividing means for dividing an input video signal into a plurality of video signals;

first factor storing means for storing at least some of a plurality of first correction factors associated with signal levels of the video signals and pixel positions in a direction orthogonal to the overlapping direction, the some first correction factors being associated with representative pixel positions;

second factor storing means for storing at least some of a plurality of second correction factors associated with signal levels of the video signals and pixel positions in a overlapping direction, the some second correction factors being associated with the representative signal levels;

first factor obtaining means for directly or indirectly obtaining a necessary first correction factor by using the first correction factors stored in the first factor storing means on the basis of a signal level of a present video signal and a pixel position in the orthogonal direction corresponding to the present video signal;

changing means for changing a value of the signal level of a video signal referred to when the second correction factor is obtained on the basis of the first correction factor obtained by the first factor obtaining means;

second factor obtaining means for directly or indirectly obtaining the second correction factor to be used for intensity modulation control by using the second correction factor stored in the second factor storing means on the basis of the signal level changed by the changing means and the pixel position in the overlapping direction corresponding to the present video signal;

control means for performing the intensity modulation control on each of the video signals for the plurality of split picture planes so that a total of intensity values in the same pixel position in an overlapped area on the picture plane scanned based on the video signals for the plurality of split picture planes becomes equal to the intensity in the same pixel position in an original image by using the second correction factor obtained by the second factor obtaining means; and a plurality of electron guns for emitting a plurality of electron beams with which the plurality of split picture planes are scanned on the basis of a video signal modulated by the control means.

2. A cathode ray tube according to claim 1, wherein when a correction factor associated with the present signal level and pixel position is not stored in the first or second factor storing means, at least one of the first and second factor obtaining means selects at least two correction factors most associated with the present signal level and pixel position from the plurality of correction factors stored in the first or second factor storing means and performs an interpolating operation using the selected correction factors to thereby obtain a necessary correction factor.

3. A cathode ray tube according to claim 1, wherein the cathode ray tube displays a color image, each of the first and second factor storing means is constructed to store correction factors color by color, each of the first and second factor obtaining means is constructed to obtain correction factors color by color, and the control means performs the intensity modulation control color by color on each of the video signals for the plurality of split picture planes.

4. An intensity controlling method for controlling intensity of an image displayed on an image display apparatus constructed to form a single picture plane by joining a plurality of split picture planes so as to be partially overlapped each other, the method comprising:

a step of directly or indirectly obtaining a necessary first correction factor on the basis of the signal level of a present video signal and a pixel position in the orthogonal direction corresponding to the present video signal by using first correction factors stored in a first factor storing means in said image display apparatus for storing at least some of a plurality of first correction factors associated with signal levels of the video signals and pixel positions in a direction orthogonal to the overlapping direction, the some first correction factors being in representative pixel positions; and a step of changing a value of the signal level of a video signal which is referred to when a second correction factor is obtained on the basis of the first correction factor obtained;

a step of directly or indirectly obtaining a second correction factor to be used for intensity modulation control on the basis of the changed signal level and the pixel position in the overlapping direction corresponding to the present video signal by using the second correction factors stored in a second factor storing means in said image display apparatus for storing at lest some of a plurality of second correction factors associated with signal levels of the video signals and pixel positions in the direction of overlapping the plurality of split picture planes, the some second correction factors being at representative signal levels; and a step of performing the intensity modulation control on each of the video signals for the plurality of split picture planes so that a total of intensity values in the same pixel position in an overlapped area on the picture plane scanned on the basis of the video signals for the plurality of split picture planes becomes equal to the intensity in the same pixel position in an original image by using the second correction factor obtained.

5. An intensity controlling method according to claim 4, wherein in at least one of the step of obtaining the first correction factor and the step of obtaining the second correction factor, when a correction factor associated with the present signal level and pixel position is not stored in the first or second factor storing means, at least two correction factors most associated with the present signal level and pixel position are selected from the plurality of correction factors stored in the first or second factor storing means and an interpolating operation using the selected correction factors is performed to thereby obtain a necessary correction factor.

6. An intensity controlling method according to claim 4, wherein the method controls intensity of a color image displayed on an image display apparatus for displaying a color image, in which each of the first and second factor storing means is constructed to store correction factors color by color, in each of the step of obtaining the first correction factor and the step of obtaining the second correction factor, the correction factors are obtained color by color, and in the step of performing the intensity modulation control, the intensity modulation control is performed color by color on each of the video signals for the plurality of split picture planes.

7. An apparatus for controlling intensity of an image displayed on an image display apparatus constructed to form a single picture plane by joining a plurality of split picture planes so as to be partially overlapped with each other, the image display apparatus comprising:

first factor storing means for storing at least some of a plurality of first correction factors associated with signal levels of the video signals and pixel positions in a direction orthogonal to the overlapping direction, the some first correction factors being in representative pixel positions; and second factor storing means for storing at least some of a plurality of second correction factors associated with signal levels of the video signals and pixel positions in the direction of overlapping the plurality of split picture planes, the some second correction factors being at representative signal levels, means for directly or indirectly obtaining a necessary first correction factor on the basis of the signal level of a present video signal and a pixel position in the orthogonal direction corresponding to the present video signal by using the first correction factors stored in the first factor storing means;

means for changing a value of the signal level of a video signal which is referred to when the second correction factor is obtained on the basis of the first correction factor obtained;

means for directly or indirectly obtaining a second correction factor to be used for intensity modulation control on the basis of the changed signal level and the pixel position in the overlapping direction corresponding to the present video signal by using the second correction factors stored in the second factor storing means; and means for performing the intensity modulation control on each of the video signals for the plurality of split picture planes so that a total of intensity values in the same pixel position in an overlapped area on the picture plane scanned on the basis of the video signals for the plurality of split picture planes becomes equal to the intensity in the same pixel position in an original image by using the second correction factor obtained.

8. An intensity controlling apparatus according to claim 7, wherein in at least one of the means for obtaining the first correction factor and the means for obtaining the second correction factor, when a correction factor associated with the present signal level and pixel position is not stored in the first or second factor storing means, at least two correction factors most associated with the present signal level and pixel position are selected from the plurality of correction factors stored in the first or second factor storing means and an interpolating operation using the selected correction factors is performed to thereby obtain a necessary correction factor.

9. An intensity controlling apparatus according to claim 7, wherein the means for controlling intensity of a color image displayed on an image display apparatus for displaying a color image, in which each of the first and second factor storing means is constructed to store correction factors color by color, in each of the means for obtaining the first correction factor and the means for obtaining the second correction factor, the correction factors are obtained color by color, and in the means for performing the intensity modulation control, the intensity modulation control is performed color by color on each of the video signals for the plurality of split picture planes.

* * * * *

UNITED STATES PATENT AND TRADEMARK OFFICE

CERTIFICATE OF CORRECTION

PATENT NO. : 6,580,233 B2
DATED : June 17, 2003
INVENTOR(S) : Satoru Nakanishi et al.

It is certified that error appears in the above-identified patent and that said Letters Patent is hereby corrected as shown below:

Column 28,
Line 21, replace “lest” with -- least --.

Signed and Sealed this

Thirteenth Day of July, 2004

JON W. DUDAS
*Acting Director of the United States Patent and Trademark Office*